US011608585B2

(12) United States Patent
Bray

(10) Patent No.: US 11,608,585 B2
(45) Date of Patent: Mar. 21, 2023

(54) SYSTEMS AND METHODS FOR PREVENTING LAUNDRY TANGLES

(71) Applicant: Brayniacs LLC, Denver, CO (US)

(72) Inventor: Cynthia Moltz Bray, Denver, CO (US)

(73) Assignee: Brayniacs LLC, Denver, CO (US)

( * ) Notice: Subject to any disclaimer, the term of this patent is extended or adjusted under 35 U.S.C. 154(b) by 78 days.

(21) Appl. No.: 17/367,904

(22) Filed: Jul. 6, 2021

(65) Prior Publication Data

US 2021/0332524 A1 Oct. 28, 2021

Related U.S. Application Data

(63) Continuation of application No. 16/850,546, filed on Apr. 16, 2020, now Pat. No. 11,078,621.

(60) Provisional application No. 62/949,403, filed on Dec. 17, 2019, provisional application No. 62/844,041, filed on May 6, 2019.

(51) Int. Cl.

| | |
|---|---|
| ***D06F 59/08*** | (2006.01) |
| ***D06F 59/02*** | (2006.01) |
| ***D06F 39/00*** | (2020.01) |

(52) U.S. Cl.

CPC ..... *D06F 59/08* (2013.01); *D06F 39/00* (2013.01); *D06F 59/02* (2013.01)

(58) Field of Classification Search

CPC ..... D06F 59/02; D06F 39/00
USPC ..... 34/269
See application file for complete search history.

(56) References Cited

U.S. PATENT DOCUMENTS

| | | | | |
|---|---|---|---|---|
| 1,532,510 | A * | 4/1925 | Mathews | D06F 55/02 24/517 |
| 3,645,425 | A | 2/1972 | Witzke | |
| 3,900,181 | A * | 8/1975 | Pitanis | A47F 5/0006 248/340 |
| 4,554,804 | A | 11/1985 | Ploch et al. | |
| 4,708,271 | A | 11/1987 | Grommes | |
| 5,361,516 | A | 11/1994 | Dahman | |
| 6,516,536 | B2 | 2/2003 | Ryden | |
| 6,923,350 | B2 | 8/2005 | Gouldson et al. | |
| 7,036,670 | B2 | 5/2006 | Lam | |
| 7,770,305 | B1 | 8/2010 | Krauss | |
| 8,365,361 | B1 | 2/2013 | Ahern | |

(Continued)

FOREIGN PATENT DOCUMENTS

| | | | | |
|---|---|---|---|---|
| DE | 4200902 | A1 * | 7/1993 | D06F 95/008 |
| EP | 2893852 | A1 | 7/2015 | |

(Continued)

*Primary Examiner* — Stephen M Gravini
(74) *Attorney, Agent, or Firm* — Acuity IP, LLC; Nathan S. Cassell

(57) ABSTRACT

Systems and methods for attaching large articles of bedding such as bed sheets, blankets, duvet covers, comforters, and quilts, as well as other machine-washable large items such as sleeping bags, tablecloths, shower curtains, and shower curtain liners, in order to prevent or greatly reduce said articles from twisting, tangling, balling and/or wadding either independently or with each other in either or both the automatic washing machine or automatic clothes dryer. Exemplary fabric securing devices include a rigid base having keyholes and slit-holes, and flexible straps or tongues having a hollow post to engage a base keyhole and a crescent-shaped beveled edge to engage a base slit-hole.

18 Claims, 19 Drawing Sheets

(56) References Cited

U.S. PATENT DOCUMENTS

| | | | | |
|---|---|---|---|---|
| 8,459,067 | B2 | 6/2013 | Kendall et al. | |
| D832,539 | S | 10/2018 | Baird | |
| 10,465,333 | B1 | 11/2019 | Baird | |
| 10,633,787 | B1 * | 4/2020 | Pham | D06F 95/008 |
| 10,935,317 | B2 * | 3/2021 | Minnite | F26B 25/004 |
| 11,078,621 | B2 * | 8/2021 | Bray | D06F 39/00 |
| 2009/0266851 | A1 | 10/2009 | Perlman et al. | |
| 2010/0205787 | A1 | 8/2010 | Remmert | |
| 2016/0278440 | A1 * | 9/2016 | Kaspi | A41B 11/002 |
| 2017/0356123 | A1 * | 12/2017 | Sopoliga | D06F 59/06 |
| 2020/0354882 | A1 | 11/2020 | Bray | |
| 2021/0332524 | A1 * | 10/2021 | Bray | D06F 59/08 |

FOREIGN PATENT DOCUMENTS

| | | | |
|---|---|---|---|
| KR | 20090099015 | A | 9/2009 |
| WO | WO-2019223816 | A1 * | 11/2019 |

* cited by examiner

SYSTEMS AND METHODS FOR PREVENTING LAUNDRY TANGLES

CROSS-REFERENCES TO RELATED APPLICATIONS

This application is a continuation of U.S. patent application Ser. No. 16/850,546 filed Apr. 16, 2020, which claims the benefit of U.S. Provisional Patent Application No. 62/844,041 filed May 6, 2019 and U.S. Provisional Patent Application No. 62/949,403 filed Dec. 17, 2019. The content of each of the above filings is incorporated herein by reference.

FIELD OF THE INVENTION

Embodiments of the present invention encompass systems and methods for coupling one section of a laundry item with another portion of the laundry item, so as to prevent or inhibit the laundry item from twisting, tangling, balling, and/or wadding in the clothing washer and/or dryer. Particularly, embodiments of the present invention relate to the laundering of bedding such as sheets, duvet covers, blankets, quilts, and/or comforters, as well as tablecloths, sleeping bags, shower curtains, and shower curtain liners. More particularly, either one or multiple large laundry items can be laundered alone or together and still not twist, tangle, ball or wad with itself or other large articles throughout the process allowing all articles to clean and dry efficiently. Embodiments of the present invention additionally reduce the likelihood of small articles becoming lodged in the larger articles throughout the washing and drying process. Further, embodiments of the present invention relate to a device for preventing the twisting, tangling, balling, and wadding of long-sleeve shirts and long pants in the clothing washer.

BACKGROUND OF THE INVENTION

Large laundry items often twist, tangle, ball, and/or wad with themselves or each other in either or both the washing machine or the clothing dryer, preventing the articles from getting as clean as possible and/or from drying properly, resulting in wrinkled articles and/or wet spots. Consumers must often manually manipulate their laundry loads to eliminate the twists, tangles, balls, and wads. Often the consumer's washing machine becomes off-balance due to a large mass of large articles getting twisted, tangled, balled and/or wadded, and the large articles must be repositioned for the washing cycle to complete. Often the consumer has to stop the dryer several times per load in order to manipulate the articles before their articles will fully dry. The load often takes several cycles to completely dry. The consumer spends time, energy, and money on these maneuvers in order to ultimately achieve clean and dry articles.

Some consumers additionally have a problem with their long-sleeve shirts and long pants twisting, tangling, balling, and wadding in the clothing washer, which can send the load off balance as well as set in wrinkles in the clothes.

As appliance manufactures have increased the capacity of dryers, consumers are experiencing greater problems with twisting, tangling, balling and wadding. Additionally, consumers are reporting increased problems with high-efficiency washing machines going off-balance. Varied and contradictory advice reduces the problem sporadically; however, an effective solution to wash and dry these articles consistently without twisting, tangling, balling and wadding does not exist. Conflicting advice for addressing these issues ranges from laundering the bedding alone, to laundering the bedding with other articles, to laundering the bedding one sheet at a time, to laundering the bedding with tennis balls, and/or laundering the bedding with dryer balls. There is no available method to effectively prevent the problem in the washing machine. Currently, the only known method that is guaranteed to solve the problem in drying sheets is to hang the articles on a clothes line, which many modern consumers cannot or will not do.

In order to reduce wadding, many consumers have taken to running smaller loads, equating to more total loads of laundry. More laundry loads consumes more water, more energy, more detergent, more bleach, more fabric softener, more dryer sheets, and more time. More loads also leads to more wear-and-tear on the appliances, resulting in more frequent service calls and decreased life-span of appliances. Additionally, off-balance washer loads create great stress on the appliance, creating greater wear-and-tear, increasing service calls, and decreasing the life of the washer.

Therefore, a need exists for novel systems and methods that will prevent large articles from becoming twisted, tangled, balled, or wadded throughout the entire laundering process. A need also exists for novel systems and methods that will prevent long-sleeve shirts and long pants from becoming twisted, tangled, balled, or wadded in the washing machine. There is also a need for the systems and methods to be simple, easy to use and/or operate, affordable, gentle on the fabric, gentle on the appliances, easily stored, tolerant of hot and cold water, tolerant of hot and cold air, tolerant of a tumbling action, tolerant of common laundry detergents, tolerant of common laundry stain removers, and tolerant of common laundry disinfectants. Finally, there is a need for the systems and methods to be effective on a variety of fabrics, sizes, and thicknesses of large laundry articles, and to be effective for preventing or inhibiting smaller articles from becoming lodged in the larger articles during the laundry process. Embodiments of the present invention provide solutions for at least some of these outstanding needs.

BRIEF SUMMARY OF THE INVENTION

Embodiments of the present invention encompass a novel laundry device having a center base with an attachment system to gather, contain, and hold a number of corners (e.g. up to four) and/or portions (e.g. sides) of a large laundry article such as a sheet. In some cases, a novel laundry device can include a center base with an attachment system to gather, contain, and hold a number of points (e.g. up to three or more) and/or portions (e.g. sides) of a sheet or any other laundry article. For example, an attachment system can operate to secure three points (e.g. two sleeves/legs and the bottom hem/waistband) for long-sleeve shirts and long pants. Based on the physics and mathematics of knot theory, the probability of large laundry items twisting, tangling, balling and wadding is greatly reduced in this configuration. The probability of long-sleeve shirts and long pants is also reduced when in this configuration. Laundry devices disclosed herein can also operate to prevent or inhibit smaller laundry articles from becoming lodged in the larger laundry articles during the laundering process.

In some cases, laundry devices for use with large laundry items such as sheets, blankets, and duvet covers, may include an attachment system having four to eight evenly spaced male elements configured to press into corresponding female elements with the large laundry article draped between the male and female elements, then the male element can be slid into a channel in the female element in order to lock, capture, and contain or secure the fabric of the laundry item. A similar male/female configuration can be provided for three points of contact for long-sleeve shirts and long pants. A laundry device's attachment system may also or alternatively include gripper clasps, clips, elastics, bands, or cords to help accomplish the goal of gathering and containing the corners and/or edges or other portions of the large laundry article to a center base. The device's attachment system may be permanently affixed to the center base, or may be separate until clipped through the large laundry article.

In one aspect, embodiments of the present invention encompass laundry devices for attaching large articles of bedding such as bed sheets, blankets, duvet covers, comforters, and quilts, as well as other machine-washable large items such as sleeping bags, tablecloths, shower curtains, and shower curtain liners, in order to prevent or greatly reduce said articles from twisting, tangling, balling and/or wadding either independently or with each other in either or both the automatic washing machine or automatic clothes dryer. In some embodiments, laundry devices include an attachment system to affix the laundry articles to a center base structure made of silicone, plastic, rubber, nylon, fabric, mesh, or a combination of these, by buttons, clips, bands and/or cords made of silicone, plastic, nylon, rubber, elastic, fabric, mesh, and/or metal or a combination of these, which are either mounted directly on the device or as separate pieces designed to work with the center base of the device. In some embodiments, laundry devices include a center base structure and buttons, clips, bands, and/or cords constructed of materials that withstand hot and cold water, hot and cold temperatures, the tumbling of the laundering process, and common laundry cleaning agents. In some cases, laundry devices include a center base structure and buttons, clips, bands, and/or cords that will be gentle on the laundry articles so as not to cause damage to them. In some cases, laundry devices include a center base structure and buttons, clips, bands, and/or cords that will be gentle on the washing machine and dryer so as not to cause damage to them. In some cases, laundry devices include a center base structure and buttons, clips, bands, and/or cords that will be colorfast so as not to alter the color of the laundry articles. In some cases, laundry devices include a center base structure and buttons, clips, bands, and/or cords which will be reusable.

In another aspect, embodiments of the present invention encompass laundry devices for attaching large articles of bedding such as bed sheets, blankets, duvet covers, comforters, and quilts, as well as other machine-washable large items such as sleeping bags, tablecloths, shower curtains, and shower curtain liners, in order to prevent or greatly reduce said articles from twisting, tangling, balling, and/or wadding either independently or with each other in either or both the automatic washing machine or automatic clothes dryer as well as reducing the likelihood that smaller laundry articles become lodged in the larger laundry articles in either or both the automatic washing machine or automatic clothes dryer. Embodiments also encompass laundry devices for attaching long-sleeve shirts and long pants in order to prevent or greatly reduce said articles from twisting, tangling, balling and/or wadding in the automatic washing machine. In some embodiments, laundry devices include an attachment system to affix the long-sleeve shirts and long pants to a center base structure made of silicone, plastic, rubber, nylon, fabric, mesh, or a combination of these, by buttons, clips, bands and/or cords made of silicone, plastic, nylon, rubber, elastic, fabric, mesh, and/or metal or a combination of these, which are either mounted directly on the device or as separate pieces designed to work with the center base of the device. In some embodiments, laundry devices include a center base structure and buttons, clips, bands, and/or cords constructed of materials that withstand hot and cold water, hot and cold temperatures, the tumbling of the laundering process, and common laundry cleaning agents. In some embodiments, laundry devices include a center base structure and buttons, clips, bands, and/or cords will be gentle on the laundry articles so as not to cause damage to them. In some embodiments, laundry devices include a center base structure and buttons, clips, bands, and/or cords will be gentle on the washing machine so as not to cause damage to it. In some embodiments, laundry devices include an a center base structure and buttons, clips, bands, and/or cords will be colorfast so as not to alter the color of the long-sleeve shirts and long pants. In some embodiments, laundry devices include a center base structure and buttons, clips, bands, and/or cords which will be reusable. Embodiments also encompass laundry devices for attaching long-sleeve shirts and long pants in order to prevent or greatly reduce said articles from twisting, tangling, balling, and/or wadding either independently or with each other in the automatic washing machine reducing the likelihood that small laundry articles become lodged in the long-sleeve shirts and long pants.

In still another aspect, embodiments of the present invention encompass fabric securing devices and methods. An exemplary fabric securing device includes a rigid base having a first keyhole, a first slit-hole located next to the first keyhole, a second keyhole, and a second slit-hole located next to the second keyhole, a first flexible tongue having a neck, a crescent-shaped beveled edge, a top surface, a bottom surface, a hollow post protruding from the top surface, and an opening in the bottom surface opposite the hollow post, and a second flexible tongue having a neck, a crescent-shaped beveled edge, a top surface, a bottom surface, a hollow post protruding from the top surface, and an opening in the bottom surface opposite the hollow post. The first keyhole is configured to receive the hollow post of the first tongue and the first slit-hole is configured to receive the beveled edge of the first tongue, thereby providing a reversible coupling between the base and the first tongue. The keyhole is configured to receive the hollow post of the second tongue and the second slit-hole is configured to receive the beveled edge of the second tongue, thereby providing a coupling between the base and the second tongue. The fabric securing device is configured to attach with an article of fabric when the hollow post of the first tongue is located in the first keyhole of the base and a first section of the article of fabric is positioned between the hollow post of the first tongue and the first keyhole of the base, and when the hollow post of the second tongue is located in the second keyhole of the base and a second section of the article of fabric is positioned between the hollow post of the second tongue and the second keyhole of the base. In some cases, the first keyhole of the base has a circular portion and a narrow portion, wherein the narrow portion is connected to the circular portion and is most narrow where the circular portion and narrow portion join and the width increases from where the circular portion and narrow portion join to the end of the narrow portion. In some cases, the hollow post of the first tongue is configured to compress when sliding from the circular portion into the narrow portion of the first keyhole of the base and expand when sliding along the narrow portion away from the circular portion of the first keyhole of the base. In some cases, the hollow post of the second tongue is configured to compress when sliding from the circular portion into the narrow portion of the second keyhole of the base and expand when sliding along the narrow portion away from the circular portion of the second keyhole of the base. In some cases, a fabric securing device further includes a third flexible tongue having a neck, a crescent-shaped beveled edge, a top surface, a bottom surface, a hollow post protruding from the top surface, and an opening in the bottom surface opposite the hollow post. The rigid base further includes a third keyhole, and a third slit-hole located next to the third keyhole. The third keyhole is configured to receive the hollow post of the third tongue and the third slit-hole is configured to receive the beveled edge of the third tongue, thereby providing a reversible coupling between the base and the third tongue. The fabric securing device is configured to further attach with the article of fabric when the hollow post of the third tongue is located in the third keyhole of the base and a third section of the article of fabric is positioned between the hollow post of the third tongue and the third keyhole of the base. In some cases, the third keyhole of the base has a circular portion and a narrow portion, wherein the narrow portion is connected to the circular portion and is most narrow where the circular portion and narrow portion join and the width increases from where the circular portion and narrow portion join to the end of the narrow portion. In some cases, the hollow post of the third tongue is configured to compress when sliding from the circular portion into the narrow portion of the third keyhole of the base and expand when sliding along the narrow portion away from the circular portion of the third keyhole of the base. In some case, the fabric securing device further includes a fourth flexible tongue having a neck, a crescent-shaped beveled edge, a top surface, a bottom surface, a hollow post protruding from the top surface, and an opening in the bottom surface opposite the hollow post. The rigid base further includes a fourth keyhole, and a fourth slit-hole located next to the fourth keyhole. The fourth keyhole is configured to receive the hollow post of the fourth tongue and the fourth slit-hole is configured to receive the beveled edge of the fourth tongue, thereby providing a reversible coupling between the base and the fourth tongue. The fabric securing device is configured to further attach with the article of fabric when the hollow post of the fourth tongue is located in the fourth keyhole of the base and a fourth section of the article of fabric is positioned between the hollow post of the fourth tongue and the fourth keyhole of the base. In some cases, the fourth keyhole of the base has a circular portion and a narrow portion, wherein the narrow portion is connected to the circular portion and is most narrow where the circular portion and narrow portion join and the width increases from where the circular portion and narrow portion join to the end of the narrow portion. In some cases, the hollow post of the fourth tongue is configured to compress when sliding from the circular portion into the narrow portion of the fourth keyhole of the base and expand when sliding along the narrow portion away from the circular portion of the fourth keyhole of the base. In some cases, the hollow post of the first tongue has an indented bowl-shaped top. In some cases, the hollow post of the second tongue has an indented bowl-shaped top. In some cases, the hollow post of the third tongue has an indented bowl-shaped top. In some cases, the hollow post of the fourth tongue has an indented bowl-shaped top. In some cases, a cap of the hollow post of the first flexible tongue has a peripheral face that is flush with a peripheral face of a stem of the hollow post of the first flexible tongue, and the stem of the hollow post of the first flexible tongue has an inner face that is disposed peripherally to an inner face of the cap of the hollow post of the first flexible tongue. In some cases, a cap of the hollow post of the second flexible tongue has a peripheral face that is flush with a peripheral face of a stem of the hollow post of the second flexible tongue, and the stem of the hollow post of the second flexible tongue has an inner face that is disposed peripherally to an inner face of the cap of the hollow post of the second flexible tongue. In some cases, a cap of the hollow post of the third flexible tongue has a peripheral face that is flush with a peripheral face of a stem of the hollow post of the third flexible tongue, and the stem of the hollow post of the third flexible tongue has an inner face that is disposed peripherally to an inner face of the cap of the hollow post of the third flexible tongue. In some cases, a cap of the hollow post of the fourth flexible tongue has a peripheral face that is flush with a peripheral face of a stem of the hollow post of the fourth flexible tongue, and the stem of the hollow post of the fourth flexible tongue has an inner face that is disposed peripherally to an inner face of the cap of the hollow post of the fourth flexible tongue.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

All illustrations of the drawings are to be describing selected embodiments of the present invention and are not intended to limit the scope of the present invention. All references of user or users pertain to either individual or individuals who would utilize embodiments of the present invention.

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise. It will be further understood that the terms "comprises" and/or "comprising" when used in this specification, specially the presence of stated features, steps, operations, elements, and/or components do not preclude the presence or addition of one or more other features, steps, operations, elements, components, and/or groups thereof.

A laundry device for preventing twisting, tangling, balling, and wadding of large articles in the clothes washer and/or dryer is discussed herein. A laundry device for preventing twisting, tangling, balling, and wadding of long-sleeve shirts and long pants in the clothes washer is also discussed herein.

The present disclosure is provided for purposes of exemplification of the invention only, and is not intended to limit the invention to the specific embodiments, materials, or processes illustrated by the figures or description contained herein.

Figure 1:
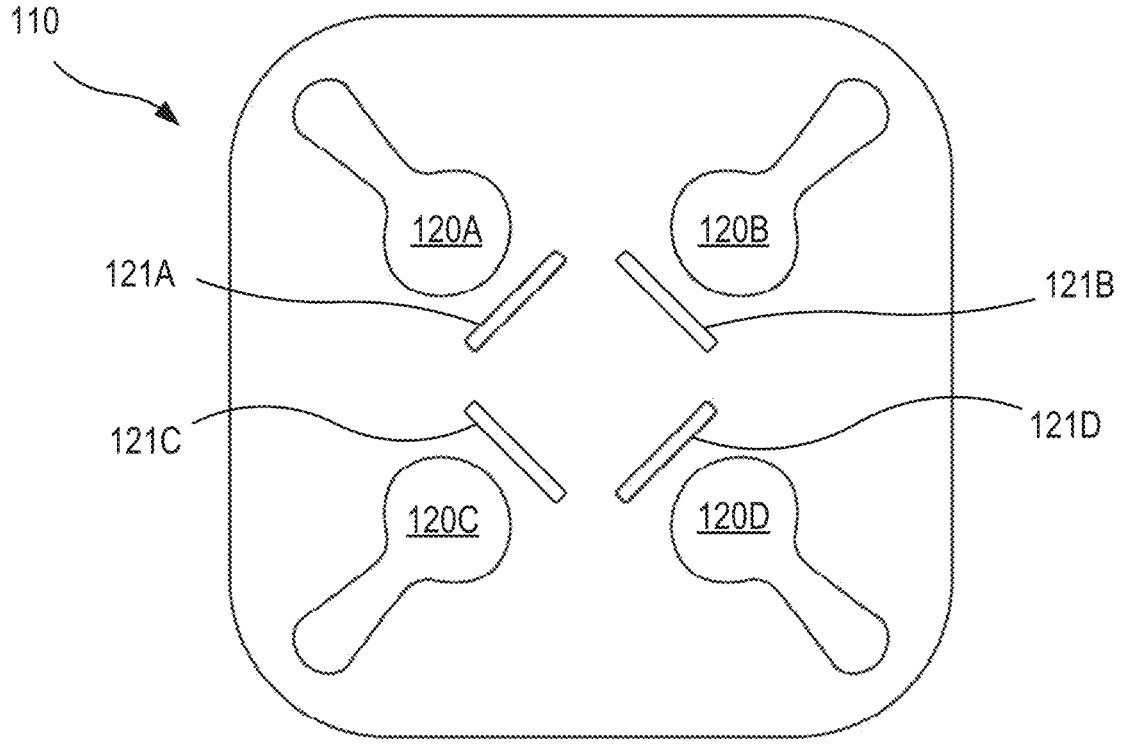
FIG. 1 depicts a top perspective view of one example of a center base with four female attachment channels according to various embodiments of the present invention.

The present invention will now be described by referencing the appended figures. Turning now to the drawings, FIG. 1 depicts a top perspective view of one example of a center base 110 with four female attachment channels (120A, 120B, 120C, 120D) and four slits (121A, 121B, 121C, 121D). In this example, the center base 110 is square with rounded corners. In other embodiments, a center base may have a different shape. As discussed elsewhere herein, the center base 110 can be configured to receive one or more attachment mechanisms (e.g. a male element such as a male button or tongue). In some cases, one or more attachments mechanisms can slide into or otherwise operationally engage one or more corresponding female channels (e.g. 120A, 120B, 120C, 120D). An attachment mechanism may also be a clip which can be attached with the center base, a clip that is fixedly attached with the center base, an attachment for a cord, and/or an attachment for an elastic member. An attachment mechanism may optionally include or be a different type of fastener. A center base 110 can include or be constructed of any of a variety of materials, including, without limitation, plastic, silicone, rubber, fabric, nylon, and/or mesh, or a combination of these materials. In some embodiments, one or more components of a center base many be molded from a single piece of material such as plastic, silicone, or rubber however the type of material is not limited to these materials.

Figure 2:
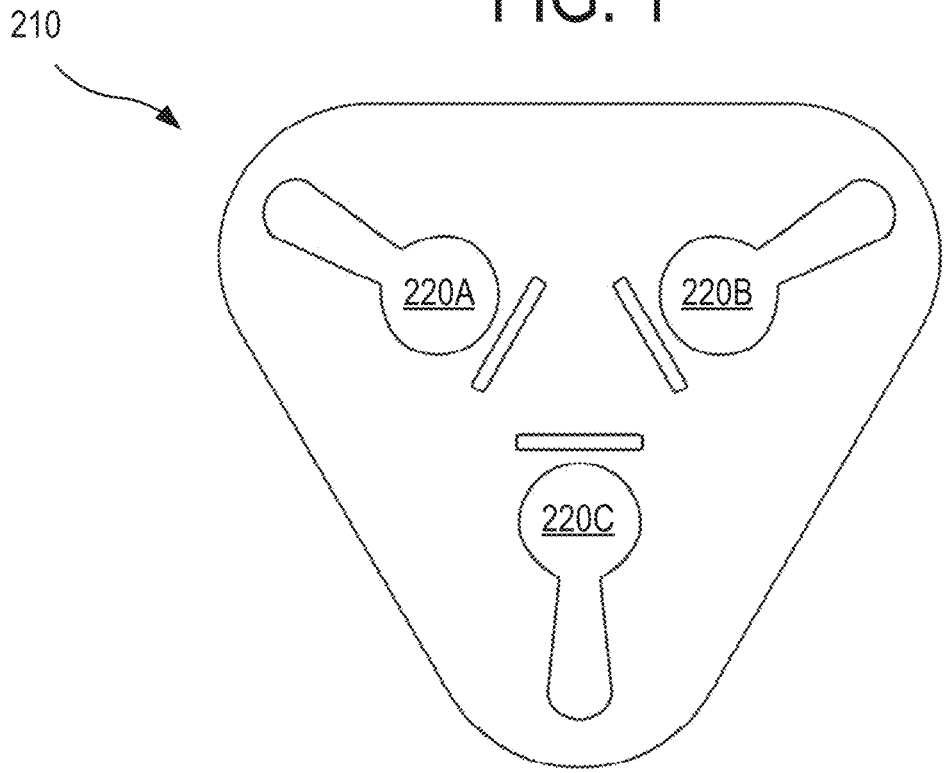
FIG. 2 depicts a top perspective view of one example of a center base with three female attachment channels according to various embodiments of the present invention.

FIG. 2 depicts a top perspective view of one example of a center base 210 with three female attachment channels (220A, 220B, 220C) and three slits.

Figure 3:
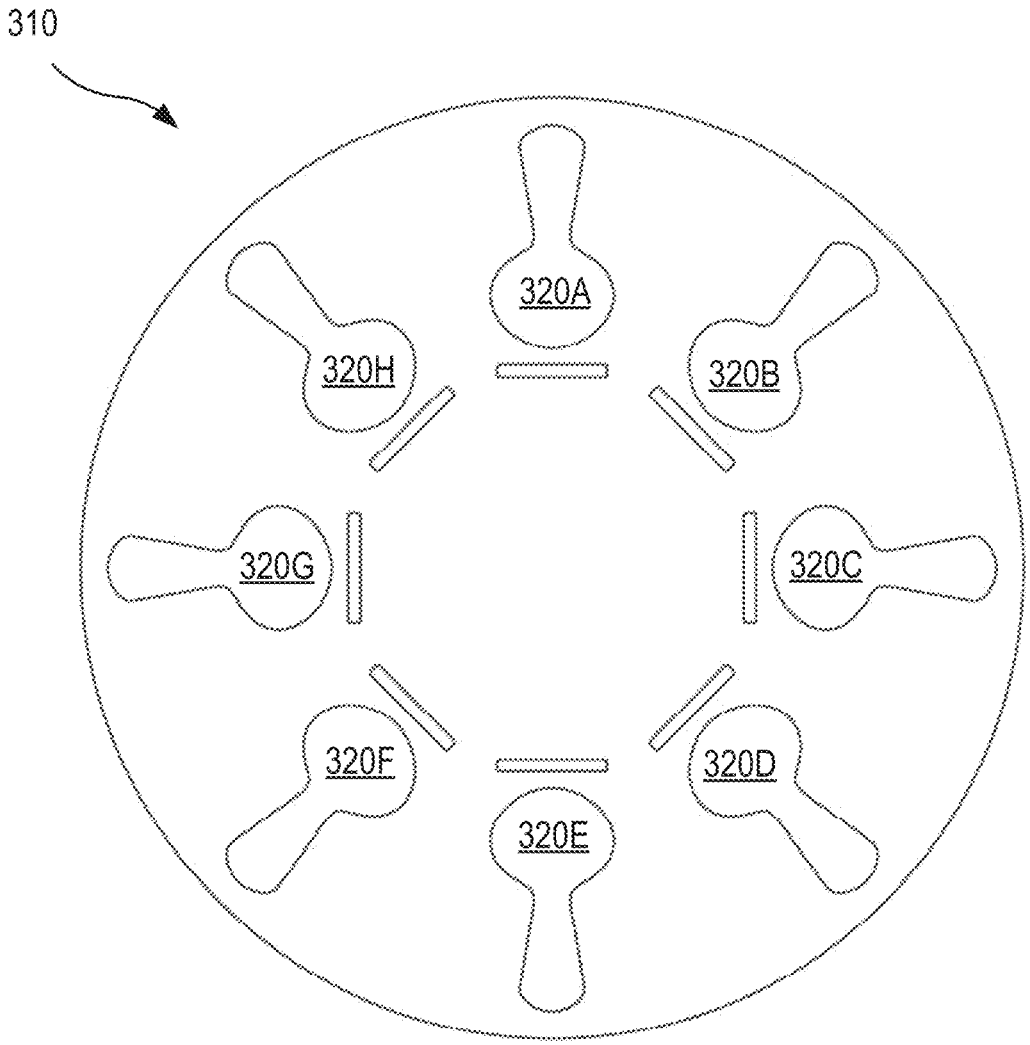
FIG. 3 depicts a top perspective view of one example of a center base with eight female attachment channels according to various embodiments of the present invention.

FIG. 3 depicts a top perspective view of one example of a center base 310 with eight female attachment channels (320A, 320B, 320C, 320D, 320E, 320F, 320G, 320H) and eight slits.

Figure 4:
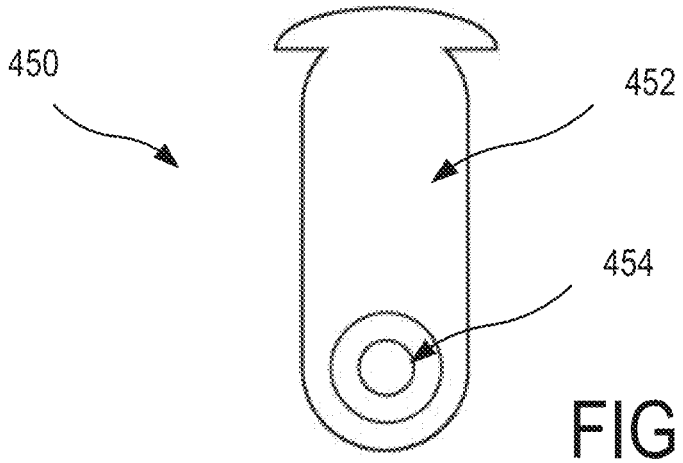
FIG. 4 depicts a top perspective view of one example of a male attachment button according to various embodiments of the present invention.

FIG. 4 depicts a top perspective view of one example of a male attachment mechanism or button 450. In some embodiments, a male attachment mechanism 450 can include a strap 452 and a button 454. An attachment mechanism (e.g. strap with button) may include or be constructed of any of a variety of materials, including, without limitation, plastic, nylon, metal, and/or silicone, or a combination of these materials.

Figure 5A:
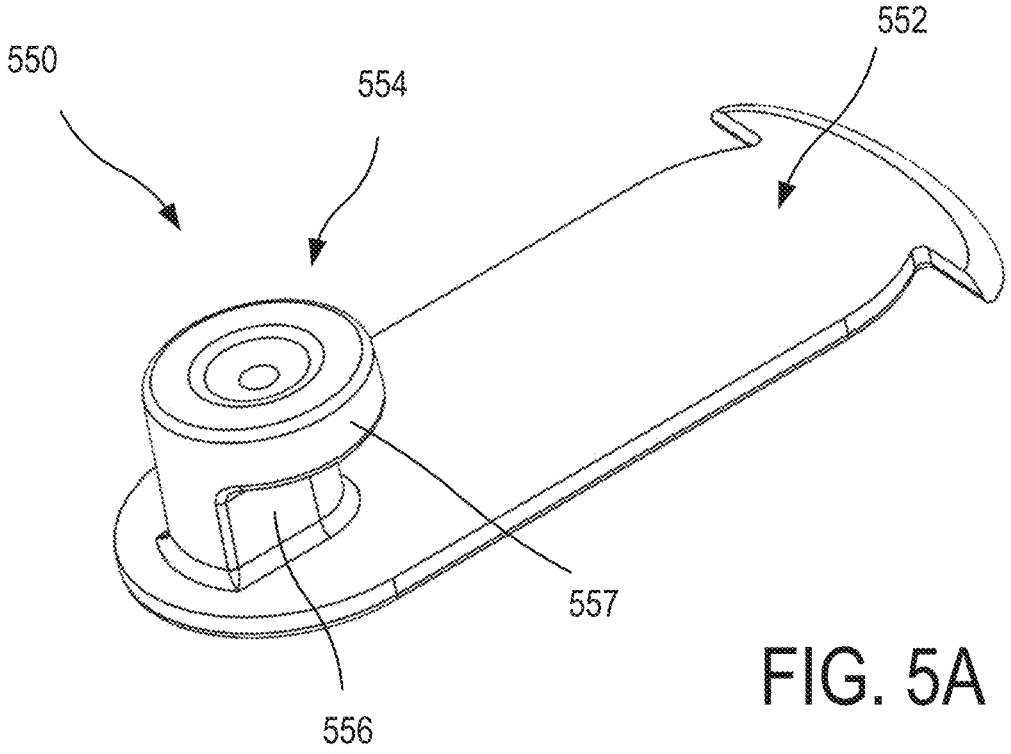
FIGS. 5A to 5E depict various views of one example of a male attachment button according to various embodiments of the present invention.
Figure 5B:
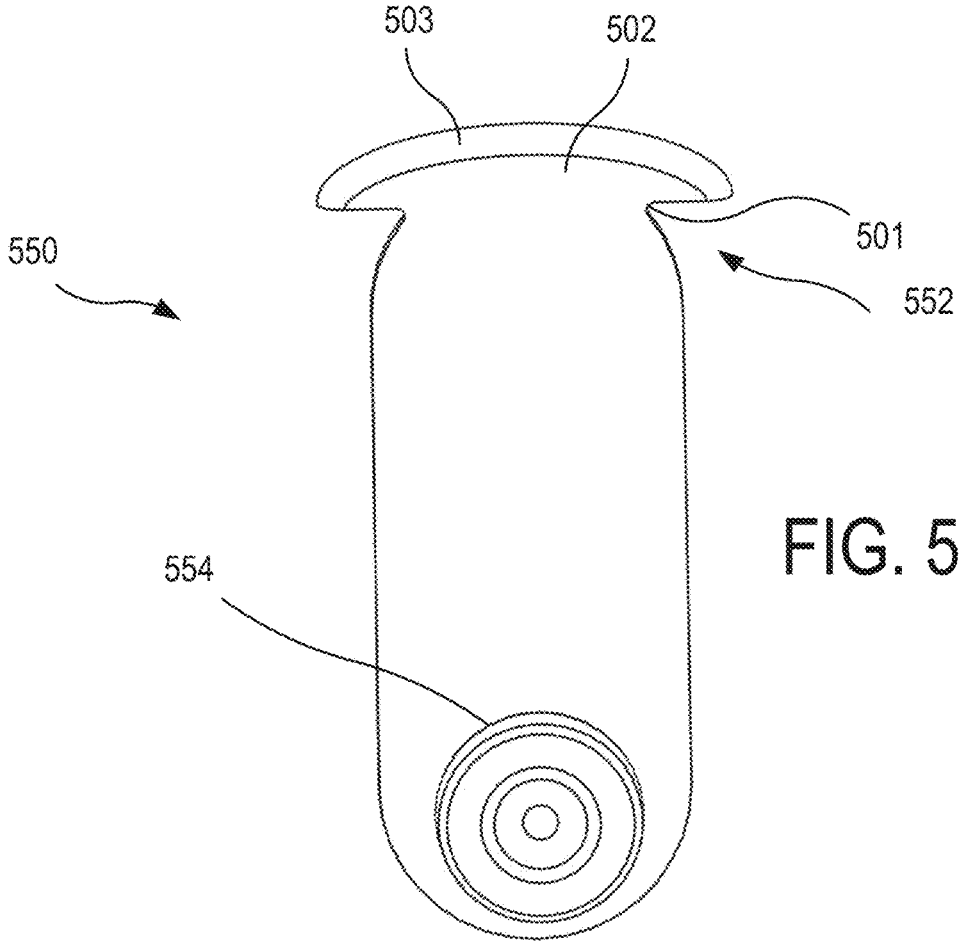

FIG. 5A depicts a substantially top perspective view of one example of a male attachment button or tongue 550. In some cases, male attachment mechanism 550 may be referred to as a strap with a tab. In some embodiments, a male attachment mechanism 550 can include a strap 552 and a first engagement mechanism, tab, or button 554. First engagement mechanism 554 includes a stem 556 and a cap 557. FIG. 5B depicts a top plan view of a male attachment element 550 according to embodiments of the present invention. As shown here, male attachment element 550 includes a first engagement mechanism 554, which in some embodiments may be a button, and a second engagement mechanism 552, which in some embodiments may be a strap. Second engagement mechanism 552 includes a neck or taper 501, and a flap or flexible tongue 502 having a beveled edge 503. In some cases, the beveled edge 503 is a crescent-shaped beveled edge.

Figure 5C:
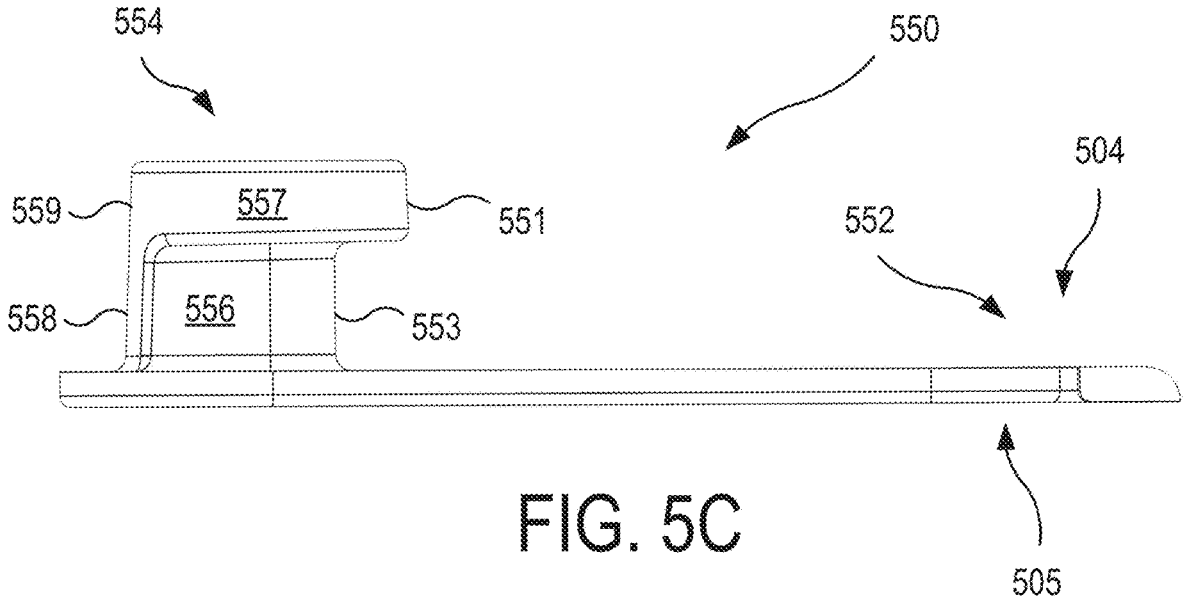

FIG. 5C depicts a side view of a male attachment element 550 according to embodiments of the present invention. As shown here, male attachment element 550 includes a first engagement mechanism 554, which in some embodiments may be a button, and a second engagement mechanism 552, which in some embodiments may be a strap. Second engagement mechanism 552 includes a top 504, a bottom 505, and a beveled edge 503 on the top 504. The first engagement mechanism 554 is configured to engage a female attachment channel, such as a keyhole of a central base. The second engagement mechanism 552 is configured to engage a slit, such as a slit of a central base. First engagement mechanism 554 includes a stem 556 and a cap 557. According to some embodiments, the stem 556 may be provided as a hollow post. According to some embodiments, the cap 557 may be provided as a top of the hollow post. In some cases, the top is an indented bowl-shaped top. In some cases, the top of the hollow post of the male attachment element or tongue is offset such that one side of the hollow post is flush with the top of the hollow post and a lip hangs over a second side of the hollow post. As shown here, the peripheral face 558 of the stem 556 is flush with the peripheral face 559 of the cap 557, and the inner face 553 of the stem 556 is disposed peripherally to the inner face 551 of the cap 557. Advantageously, because the peripheral face 558 of the stem 556 is flush with the peripheral face 559 of the cap 557, the peripheral face 558 of the stem 556 is able to more efficiently and safely compress a portion of a article of fabric against a peripheral edge of a base keyhole (e.g. against peripheral edge 624 of female attachment channel depicted in FIG. 6). Hence, a post can be flat on the side that touches the base. In this way, that flat side reduces friction to ensure there is no damage done to the fabric. If there were an undercut all around the button, the fabric could encounter more friction as it wraps around the post.

Figure 5D:
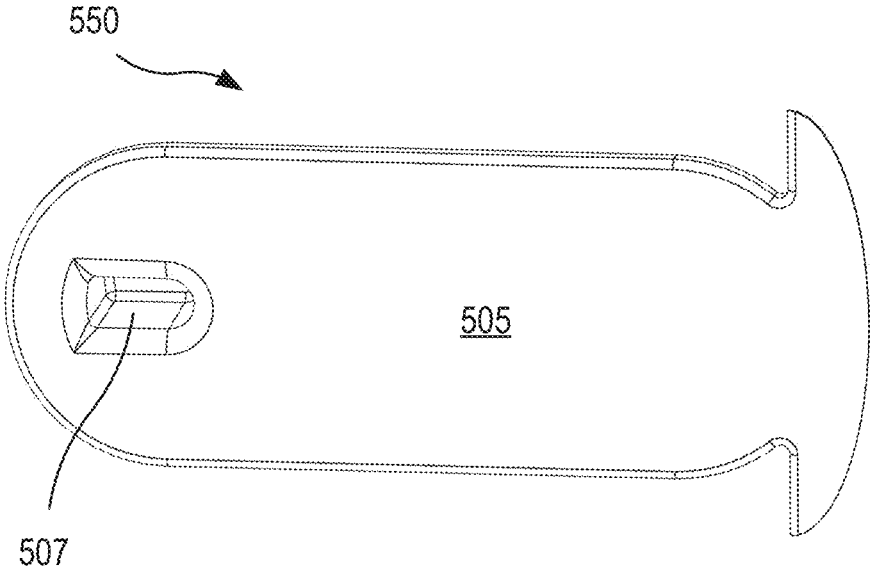
Figure 5E:
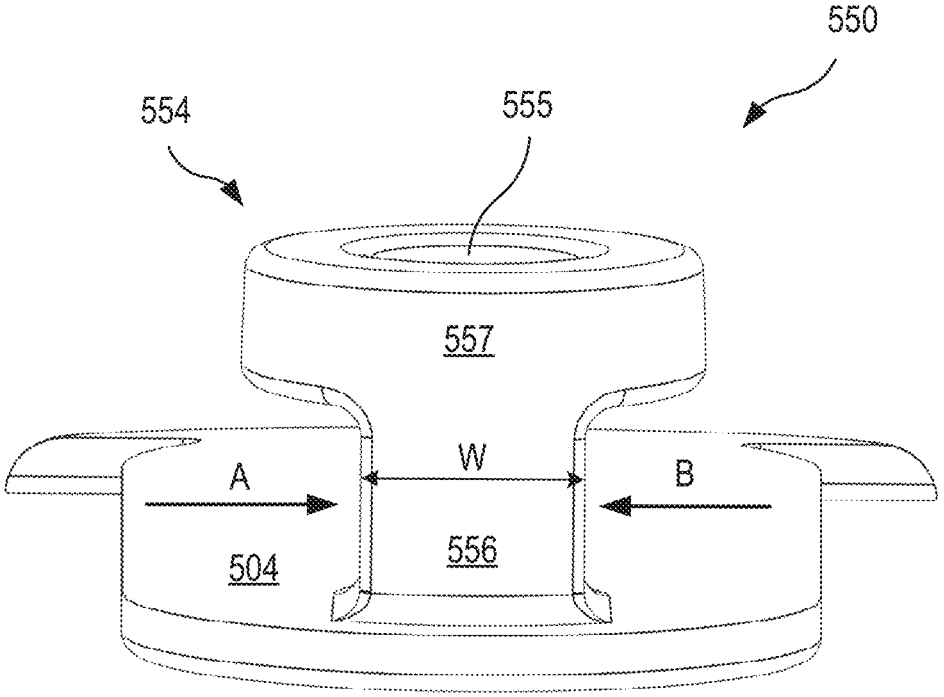

FIG. 5D depicts a bottom perspective view of a male attachment element 550 according to embodiments of the present invention. As shown here, the bottom surface 505 includes a divot or recess 507 that extends into the first engagement mechanism. When the first engagement mechanism 554 is compressed, as depicted by arrows A and B in FIG. 5E, the presence of the divot or recess within the first engagement mechanism 554 facilitates collapse or compression of the first engagement mechanism 554. In this way, the width W of the first engagement mechanism can be reduced, which allows the first engagement mechanism to slide or move within a female attachment channel of a base, which may be in the shape of a keyhole, or otherwise have a narrow waist. First engagement mechanism 554 includes a stem 556 and a cap 557. First engagement mechanism 554 also include a top depression 555. In operation, a user can place the tip of their finger or thumb into the depression 555, which can help the user to slide the first engagement mechanism 554 along a female attachment channel of a base.

In some embodiments, a system or fabric securing device includes a rigid base keyholes and slits, such as the base shown in FIG. 1. For example, a base can have a first keyhole, a first slit-hole located next to the first keyhole, a second keyhole, and a second slit-hole located next to the second keyhole. Other keyholes and slits may be present. An assembled system can also include male attachment element such as the element shown in FIGS. 5A-5E. A male attachment element can include a first flexible tongue having a beveled edge, a top surface, a bottom surface, a hollow post protruding from the top surface of the tongue, and a divot in the bottom surface of the tongue opposite the hollow post. In some cases, the first keyhole of a base is configured to receive the hollow post of the first tongue and the first slit-hole of the base is configured to receive the beveled edge of the first tongue, thereby connecting the base with the first tongue. In some embodiments, a system or fabric securing device is configured to attach with an article of fabric when the post of the first tongue is located in the first keyhole of the base and a first section of the article of fabric is positioned between the hollow post of the first tongue and the first keyhole of the base.

Figure 6:
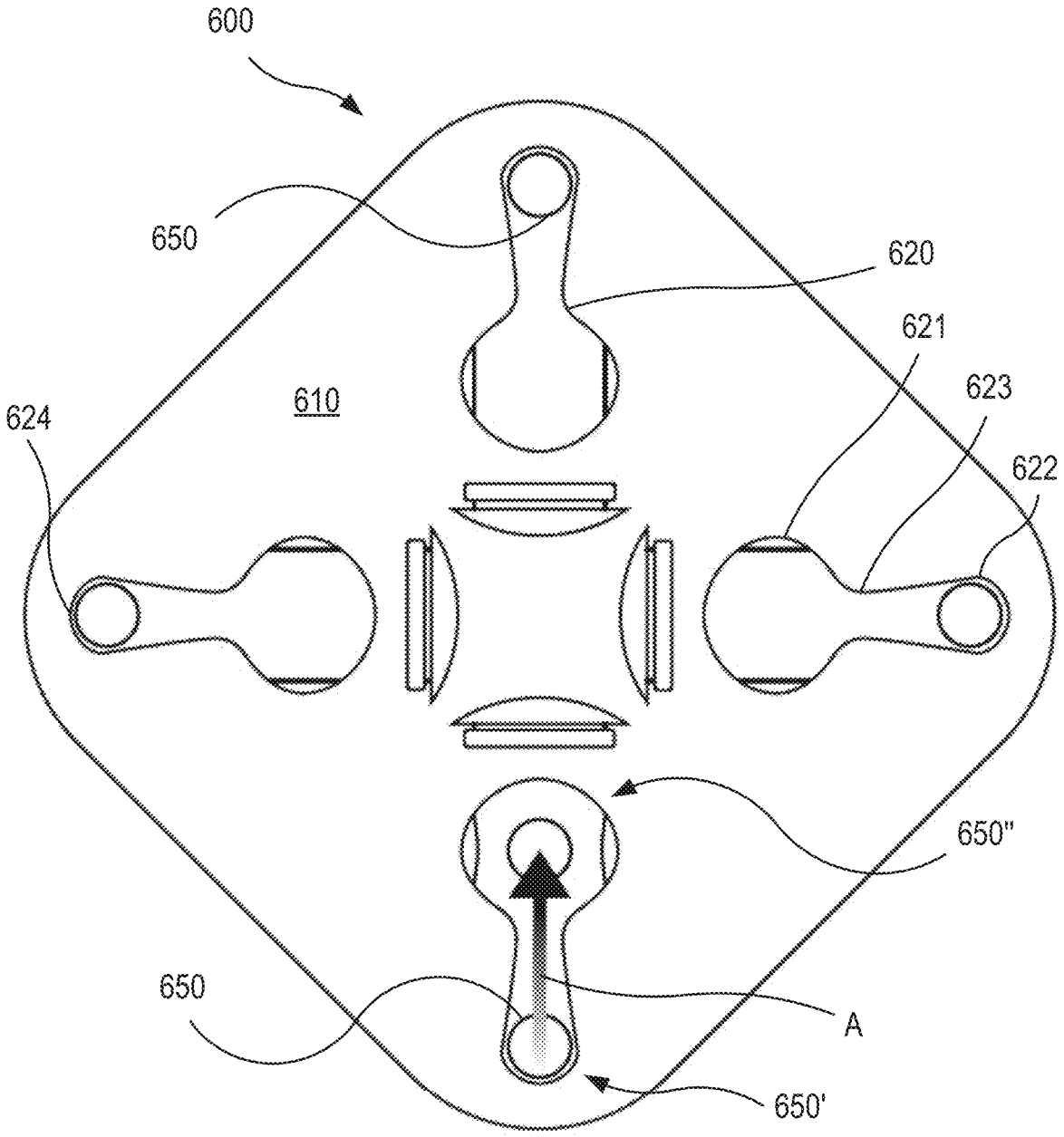
FIG. 6 depicts a top perspective view of one example of how an assembled system can mate the male attachment button into the female attachment channel according to various embodiments of the present invention.

FIG. 6 depicts a top perspective view of one example of an assembled system 600 having a central base 610 and multiple male attachment buttons. As shown here, a male attachment button 650 can mate with a female attachment channel 620 of the central base 610. As shown here, a keyhole or female attachment channel 620 can have a central circular or widened portion 621, a peripheral circular or widened portion 622, and an intermediate narrowed portion 623 therebetween. Accordingly, the width of the channel 620 can increase as the distance from the intermediate narrowed portion 623 increased toward the periphery. A hollow post or stem of the male attachment element 550 is configured to compress when sliding from the central widened portion 621 to the peripheral widened portion 622 or from the peripheral widened portion 622 to the central widened portion 621, due to the decreased width of the intermediate narrowed portion 623 (e.g. the edges of the intermediate narrowed portion 623 press upon the stem of the male attachment element, as depicted by arrows A and B in FIG. 5E). In some cases, the male attachment element 650 and/or the base 610 can include or be fabricated from polypropylene.

Figure 7:
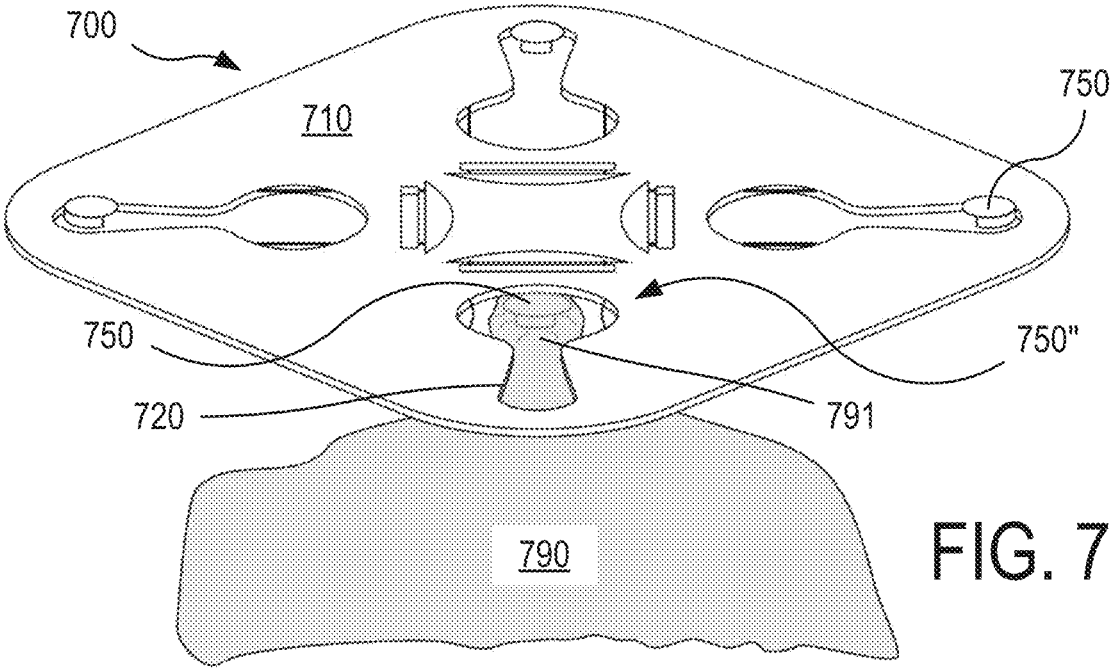
FIG. 7 depicts a substantially top perspective view of one example of how a piece of fabric inserts into an assembled system, with the male attachment button capturing the fabric into the female attachment channel according to various embodiments of the present invention.

FIG. 7 depicts a substantially top perspective view of one example of a piece of fabric 790 inserted into an assembled system 700, with a male attachment button 750 in the process of capturing the fabric into a female attachment channel 720 of a central base 710.

Figure 8:
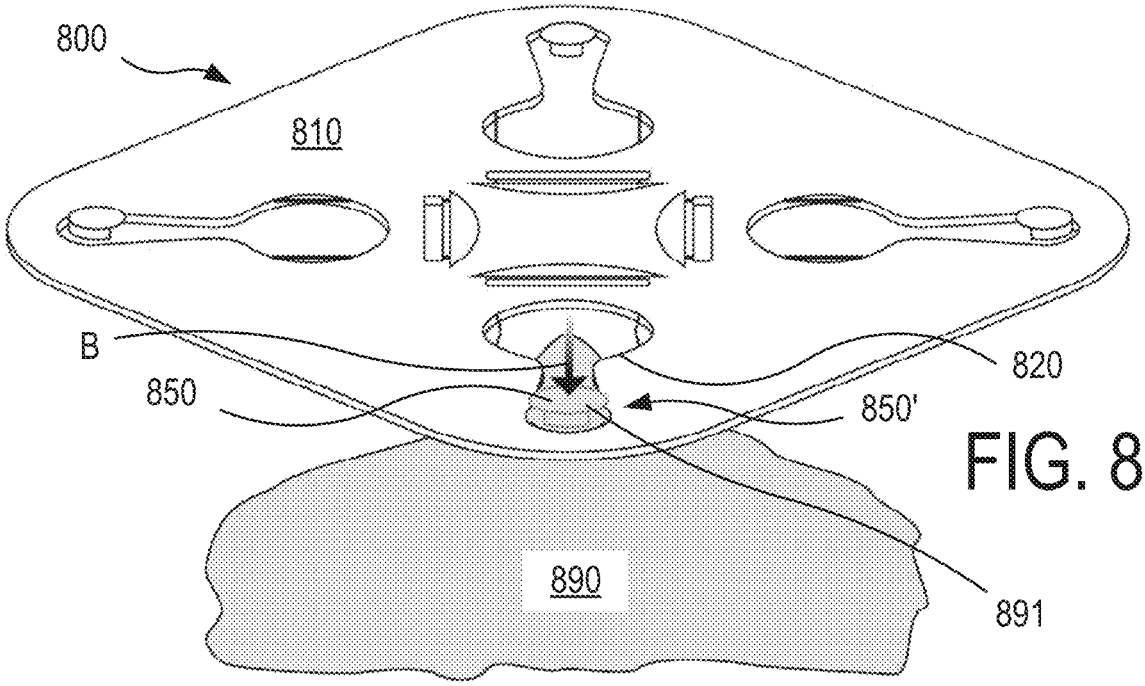
FIG. 8 depicts a substantially top perspective view of one example of how a piece of fabric is secured into an assembled system, with the male attachment button capturing the fabric into the female attachment channel according to various embodiments of the present invention.

FIG. 8 depicts a substantially top perspective view of one example of a piece of fabric 890 inserted into an assembled system 800, with a male attachment button 850 in the process of capturing the fabric into a female attachment channel 820 of a central base 810.

With reference to FIGS. 6-8, aspects of a method for coupling a laundry item with a laundry device can be described as follows. To begin, as depicted in FIG. 6, a male element (e.g. button 650) can be moved from a first position (e.g. 650', a locked position) within a female element (e.g. female attachment channel 620, which may also be referred to as a keyhole) to a second position (e.g. 650", an unlocked position) within the female element, as indicated by arrow A. Once the male element is in the second position (e.g. 650"), it can be engaged with a portion of an item of laundry or an article of fabric or other flexible sheet-like material. For example, as depicted in FIG. 7, a portion 791 of a piece of fabric (which may be a laundry item such as a sheet or t-shirt) can be draped about the male element (e.g. button 750). Next, with the portion of the piece of fabric draped over (or otherwise contacting) the male element, the male element can be moved from the unlocked position (e.g. 750") and returned to the locked position. For example, as depicted in FIG. 8, a male element (e.g. button 850) can be moved from a second position within a female element (e.g. female attachment channel 820, which may also be referred to as a keyhole) and returned to a first position (e.g. 850') within the female element, as indicated by arrow B. In this way, a portion 891 of a piece of fabric 890 can be pinched between the male element 850 and the female element 820.

Hence, the male elements and female elements are able to temporarily secure to each other through a laundry article by a slider key hole design that engages or disengages upon a sliding motion depicted by the arrows in FIGS. 6 and 8. In this example, the center base is configured with four female elements, and the four male elements are depicted on detachable straps that are inserted into a slit above the female element. The male elements and female elements, or any other attachment mechanism, is not limited to this number, shape, design, or material. The female elements, in this example rounded keyholes, are configured to receive and temporarily secure the male elements, in this example raised, rounded and buttons on a flexible strap. The female elements can include a round, oval, square, or rectangular open space or aperture surrounded on all sides by a continuous curved or straight sidewall and with an opening at one end to accept male elements (e.g. unlocked position), and channeled to secure when pulled closed (e.g. locked position), but the female elements are not limited to these shapes. In some embodiments, the female element's continuous curved or straight sidewall may contain one or more grooves or channels located in its inner surface/inside to accept male element. The male elements may be textured, grooved, rounded, and/or over-molded with a material such as silicone to provide ease of grip for the user. In some embodiments, a cord, elastic member, or gripper clip may replace or supplement the male/female grasping system.

Figure 9:
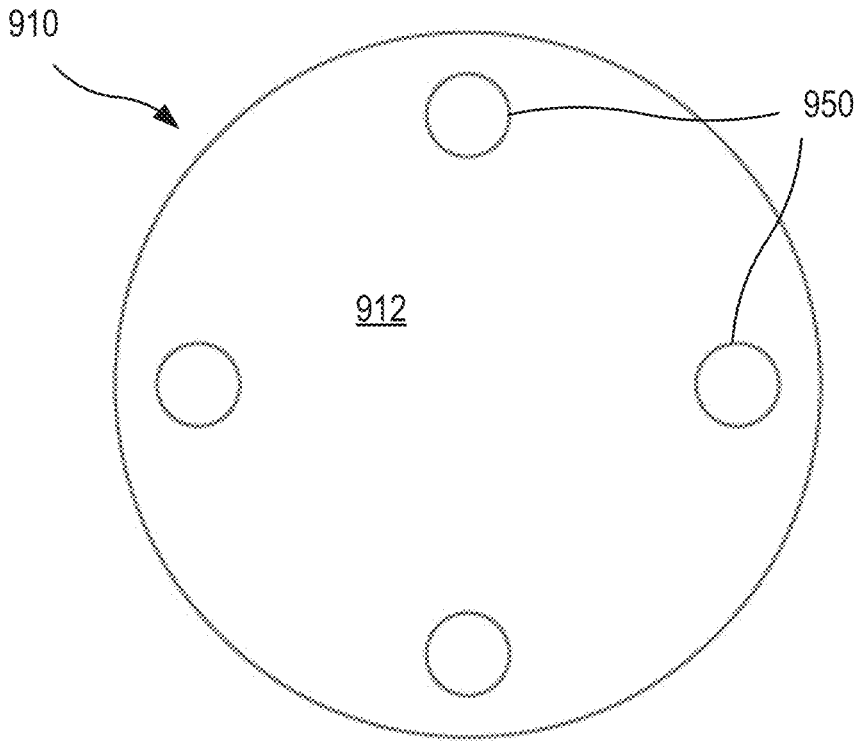
FIG. 9 depicts a top perspective view of one example of a center base according to various embodiments of the present invention.

FIG. 9 depicts a top view of one example of a center base 910 according to various embodiments of the present invention. As shown here, a center base 910 includes a plate 912 and one or more male elements (e.g. buttons 950).

Figure 10:
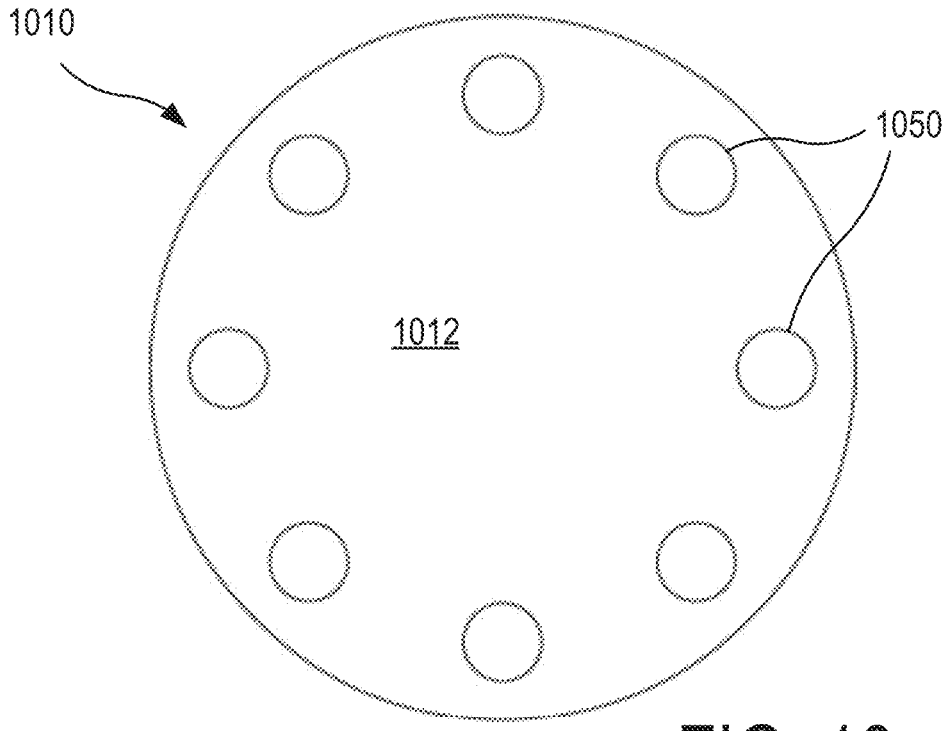
FIG. 10 depicts a top perspective view of another example of a center base according to various embodiments of the present invention.

FIG. 10 depicts a top view of another example of a center base 1010 according to various embodiments of the present invention. As shown here, a center base 1010 includes a plate 1012 and one or more male elements (e.g. buttons 1050).

Figure 11:
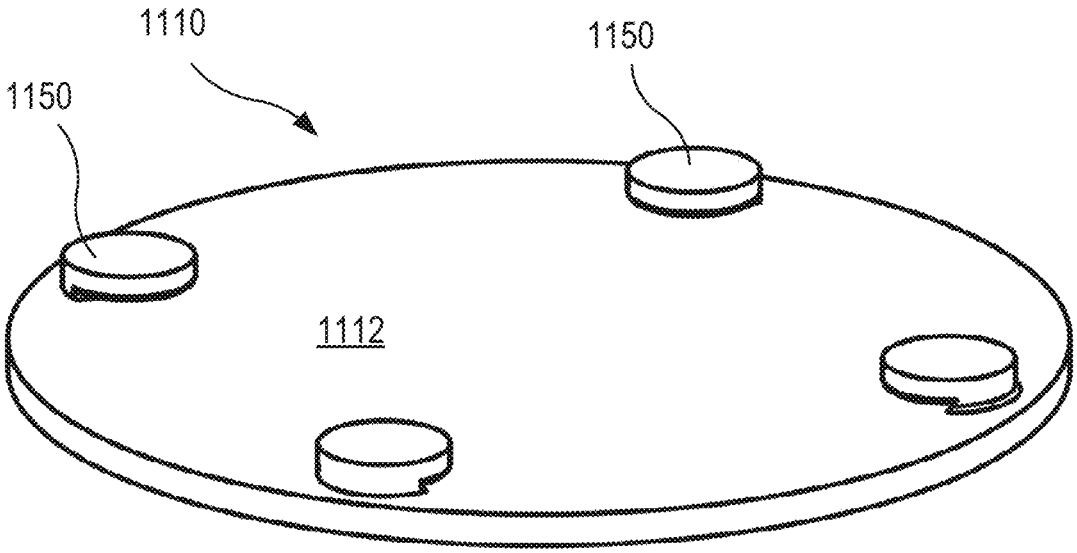
FIG. 11 depicts a substantially side perspective view of the example depicted in FIG. 9 of a center base according to various embodiments of the present invention described herein.

FIG. 11 depicts a top perspective view of a center base 1110 corresponding to the center base example depicted in FIG. 9. As shown here, a center base 1110 includes a plate 1112 and one or more male elements (e.g. buttons 1150).

Figure 12:
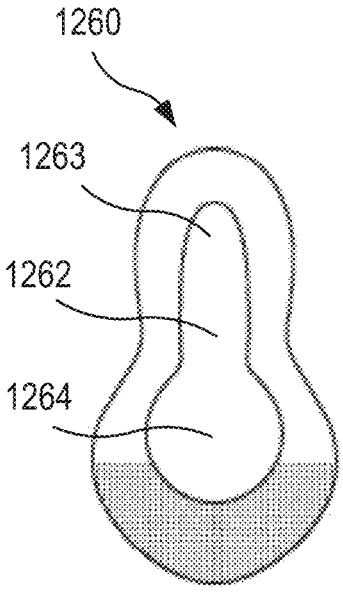
FIG. 12 depicts a top perspective view of one example of a clip according to various embodiments of the present invention described herein.

FIG. 12 depicts a top view of one example of a clip 1260 according to various embodiments of the present invention described herein. The clip 1260 includes a female portion or opening 1262 having a first end 1263 and a second end 1264. Clip 1260 can be used in conjunction with a central base (e.g. such base 1110) which has male elements. In use, a portion of a piece of fabric can be draped over or contacted with a male element of the base, and the male element can then be placed within second end 1264 (e.g. unlocked position) and then slid to the first end 1263 (e.g. locked position), in a manner analogous to the procedure discussed herein with reference to FIGS. 6-8.

Figure 13:
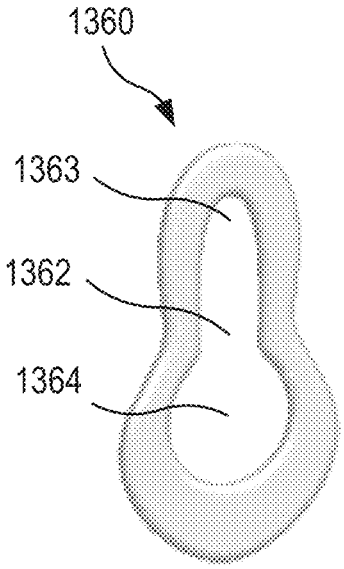
FIG. 13 depicts a substantially side perspective view of one example of a clip according to various embodiments of the present invention described herein.

FIG. 13 depicts a top view of one example of a clip 1360 according to various embodiments of the present invention described herein. The clip 1360 includes a female portion or opening 1362 having a first end 1363 and a second end 1364. Clip 1360 can be used in conjunction with a central base (e.g. such base 1110) which has male elements. In use, a portion of a piece of fabric can be draped over or contacted with a male element of the base, and the male element can then be placed within second end 1364 (e.g. unlocked position) and then slid to the first end 1363 (e.g. locked position), in a manner analogous to the procedure discussed herein with reference to FIGS. 6-8.

Figure 14:
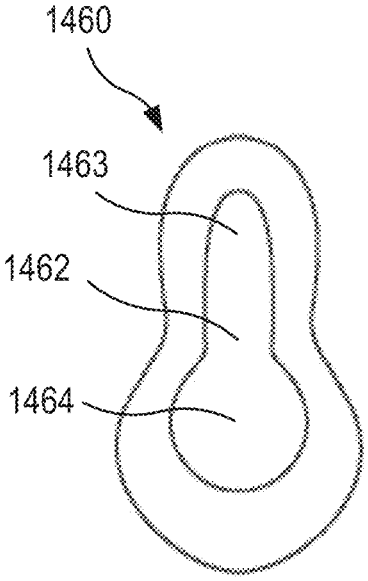
FIG. 14 depicts a top perspective view of another example of a clip according to various embodiments of the present invention described herein.

FIG. 14 depicts a top view of another example of a clip 1460 according to various embodiments of the present invention described herein. The clip 1460 includes a female portion or opening 1462 having a first end 1463 and a second end 1464. Clip 1460 can be used in conjunction with a central base (e.g. such base 1110) which has male elements. In use, a portion of a piece of fabric can be draped over or contacted with a male element of the base, and the male element can then be placed within second end 1464 (e.g. unlocked position) and then slid to the first end 1463 (e.g. locked position), in a manner analogous to the procedure discussed herein with reference to FIGS. 6-8.

Figure 15:
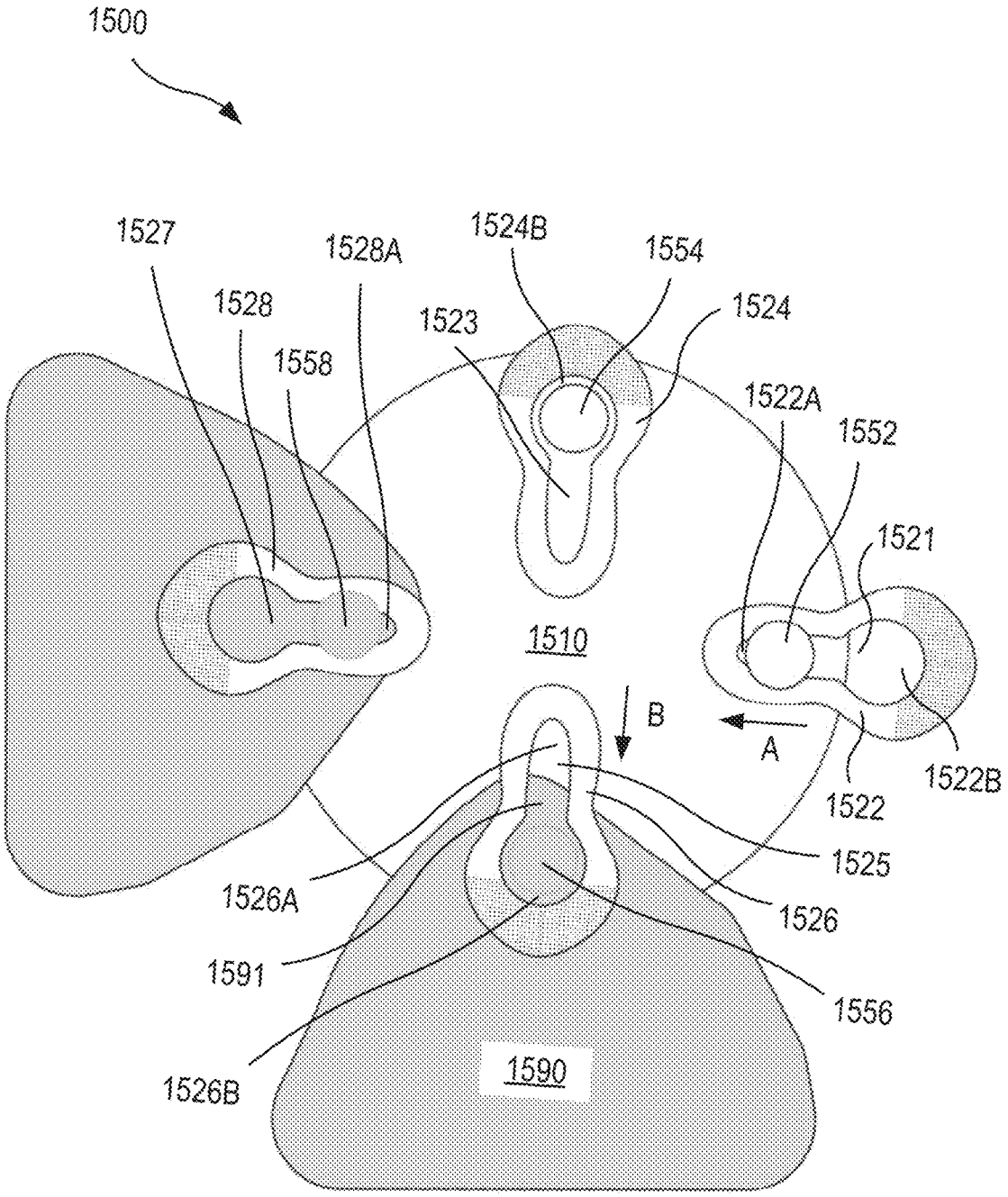
FIG. 15 depicts a top perspective view of an example of how a clip can mount a large laundry article to a center base according to various embodiments of the present invention described herein.

FIG. 15 depicts a top view of an assembled system 1500 having a central base 1510 with multiple male attachment elements (1552, 1554, 1556, 1558) and multiple female attachment elements (1522, 1524, 1526, 1528). The respective male/female element combinations depict various steps in a process of attaching a portion of a piece of fabric with the system 1500.

For example, to begin, male attachment element 1552 is disposed in a locked position at a first end 1522A of an aperture 1521 of female attachment element 1522. The female element or clip 1522 can then be moved in a direction indicated by arrow A, so that the male element 1522 is subsequently positioned at a second end 1522B of the aperture 1521. The male/female element combination 1554/1524 depicts the subsequent configuration, where the male element 1524 is positioned at a second end 1524B of an aperture 1523 of the female element 1524.

The male/female element combination 1556/1526 depicts the following configuration, where a portion 1591 of a piece of fabric 1590 is draped over or placed in contact with the male element 1556, and the male element 1556 is positioned at the second end 1526B of an aperture 1525 of the female element 1526. The female element or clip 1526 can then be moved in a direction indicated by arrow B, so that the male element 1526 is subsequently positioned at a first end 1526A of the aperture 1525. In this way, for example, a portion of a bed sheet can be placed on the center base 1510, the clip 1526 can be placed on the bed sheet, and then the clip can be moved, so that the male element or button 1556 slides up the channel or opening 1525 of the clip to lock therein.

The male/female element combination 1558/1528 depicts the subsequent configuration, where the male element 1558 is positioned at a second end 1528B of an aperture 1527 of the female element 1528. In this way, the portion 1591 of the piece of fabric 1590 can be pinched between the male element 1558 and the first end 1528A of the aperture 1527 of the female element 1528. In this way, for example, a portion of a bed sheet can be placed on the center base 1510, and the clip 1528 can be moved so that the button 1558 slides up the channel of the clip opening 1527, so as to lock the bed sheet to the center base 1510. With a sheet having four corners, each corner can be coupled or attached with a respective male/female element combination (1552/1522, 1554/1524, 1556/1526, 1558/1528). Hence, one or more clips can be used to mount a large laundry article, such as a sheet, to a center base.

After the laundering is finished, the piece of fabric can be released from the system 1500 by removing the clips in the opposite sequence (e.g. change from configuration 1558/

1528 to configuration 1556/1526) and then removing the piece of fabric. The system can the be reassembled for storage (without the piece of fabric) by reattaching the clips to the base, for example by placing each clip in the 1554/1524 configuration (e.g. a clip placed on the center base before being slid up the channel to lock) and then moving each clip to the 1552/1522 configuration (e.g. a clip placed on the center base after being slid up the channel to lock).

Figure 16:
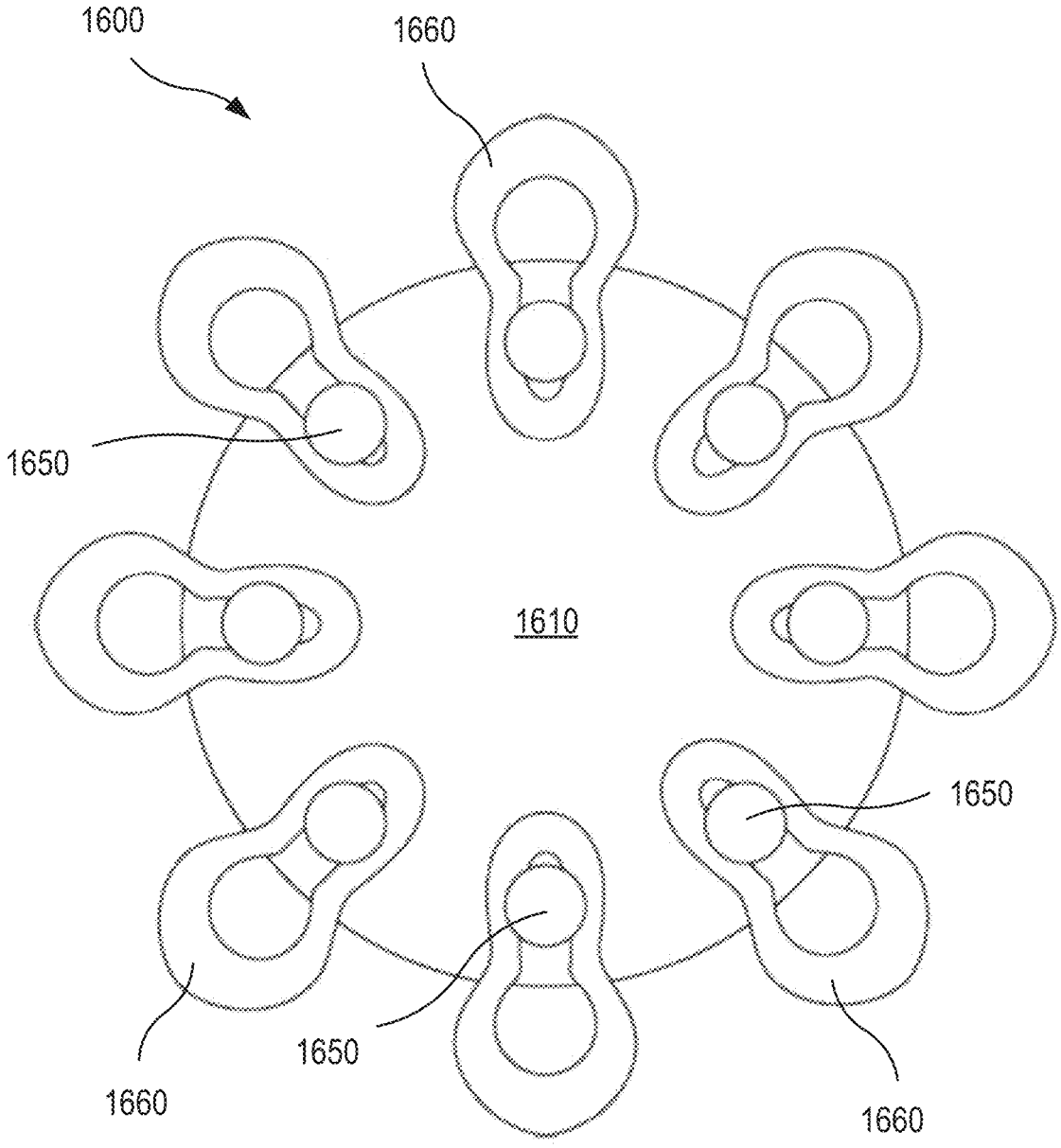
FIG. 16 depicts a top perspective view of an example of how an assembled system can work with eight clip mounts.

FIG. 16 depicts a top plan view of an assembled system 1600. As shown here, system 1600 can include a central base 1610 having multiple (e.g. eight) male attachment elements 1650, such as buttons. The system can also include multiple (e.g. eight) corresponding female attachment elements 1660, such as clips. The male attachment elements 1650 can operate in cooperation with corresponding female attachment elements 1660 in a manner similar to that which is described with reference to FIG. 15.

Figure 17:
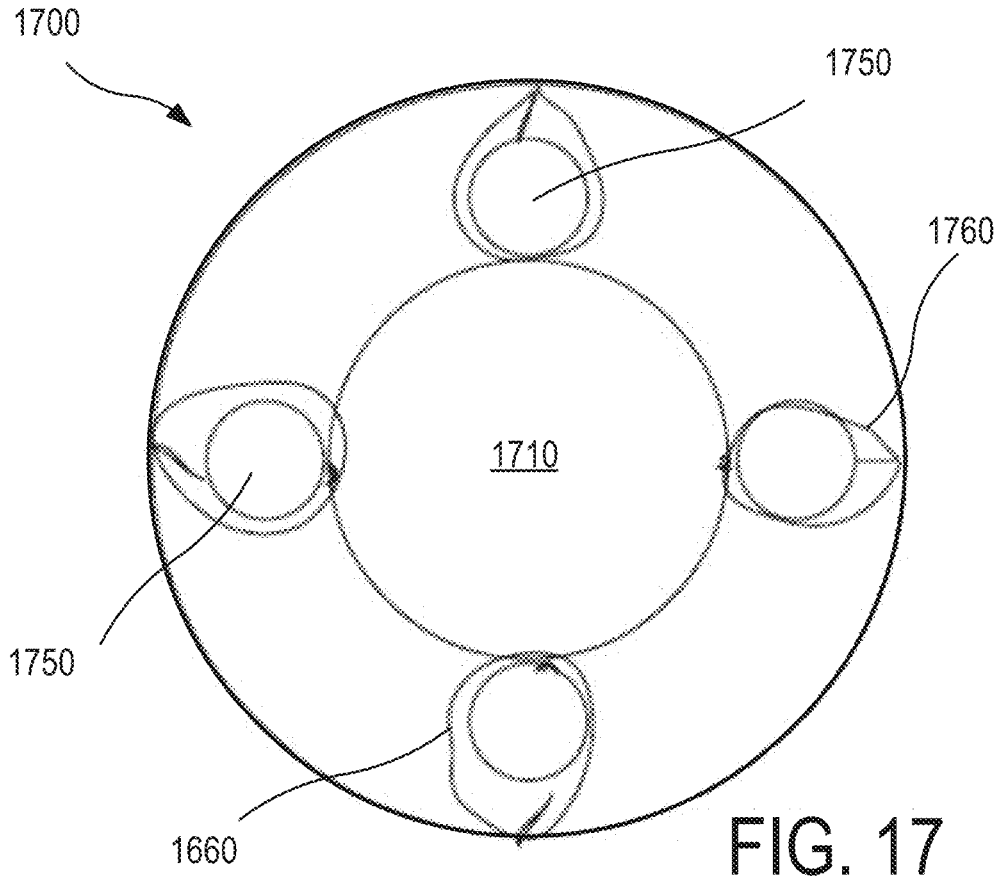
FIG. 17 depicts a top perspective view of an example of how elastics with a ball system can work to affix the laundry article to the base.

FIG. 17 depicts a top plan view of an assembled system 1700. As shown here, system 1700 can include a central base 1710 having multiple (e.g. four) male attachment elements 1750, such as balls. The system can also include multiple (e.g. four) corresponding female attachment elements 1760, such as elastic loops. In use, a portion of fabric can be draped over or placed in contact with a male attachment element, and a corresponding female attachment element can be wrapped around the fabric and male attachment element, thus reversibly securing the portion of fabric with the system by compressing it between the male and female attachment members. In this way, elastics, such as elastic loops, can be used with balls to affix a laundry article to the base 1710.

Figure 18:
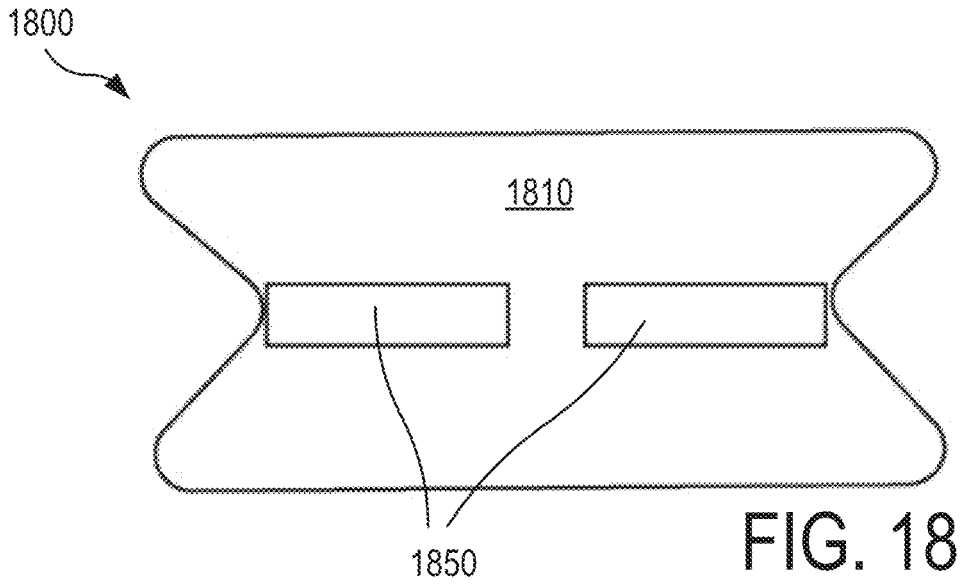
FIG. 18 depicts a top perspective view of an example of how a base can be spool shaped with an elastic band to affix the laundry article to the base.

FIG. 18 depicts a top plan view of an assembled system 1800. As shown here, system 1800 can include a central base 1810 and an elastic band 1850. The base 1810 can have a spool shape. The base and the elastic band can operate together so as to affix a laundry article to the base.

Figure 19:
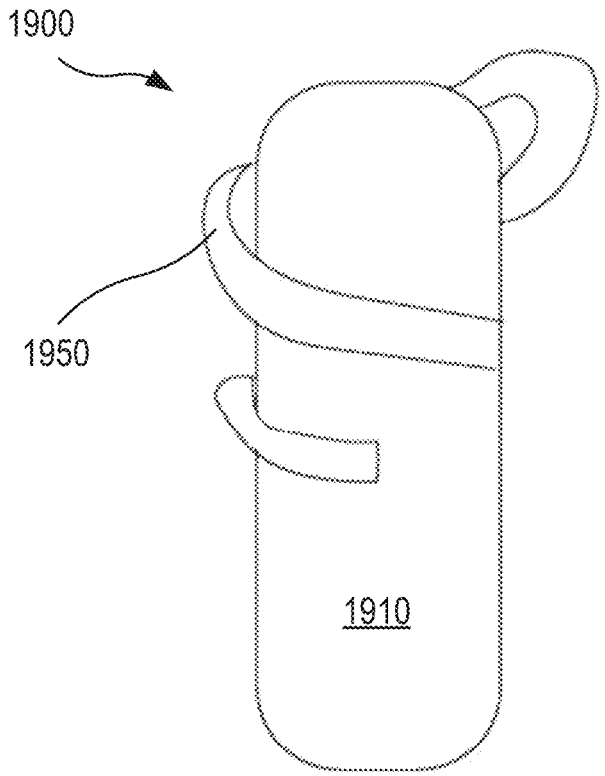
FIG. 19 depicts a side perspective view of an example of how elastic straps can attach the laundry article to a center tube.

FIG. 19 depicts a top plan view of an assembled system 1900. As shown here, system 1800 can include a central base 1910 and an elastic band 1950. The base 1810 can have a tube shape. The base and the elastic band can operate together so as to affix a laundry article to the base.

Figure 20:
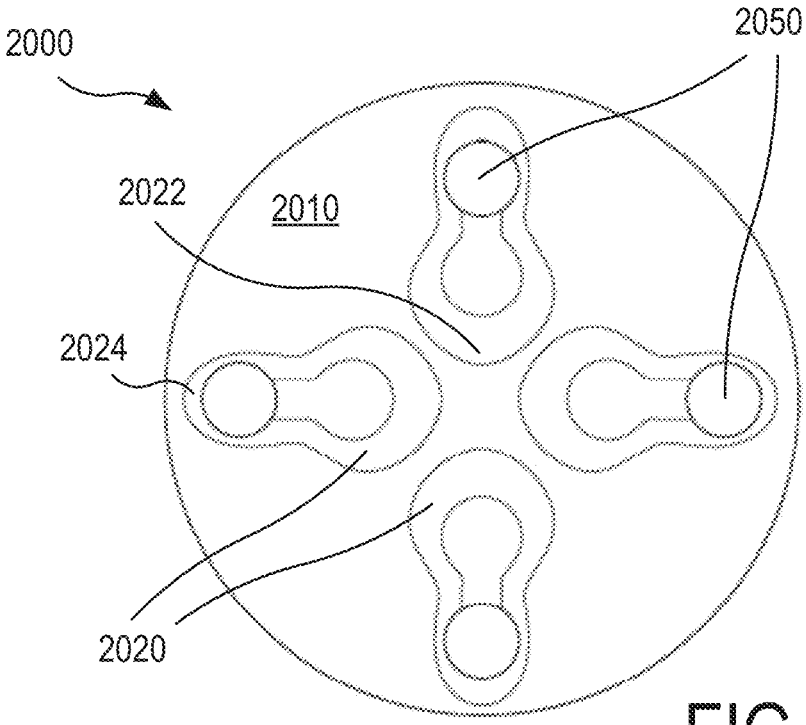
FIG. 20 depicts a top perspective view of an example of how a base and clip system can be one piece.

FIG. 20 depicts a top plan view of a one-piece system 2000 having a central base 2010 with multiple male attachment elements (e.g. 2050) and multiple female attachment elements (e.g. 2020). The male attachment elements 2050 can operate in cooperation with corresponding female attachment elements 2020 in a manner similar to that which is described with reference to FIG. 15. However in this embodiment, the female attachment elements 2020 do not detach from the base 2010. Instead, a center portion (e.g. 2022) of a female attachment element 2020 is fixed or continuous with the base 2010. A peripheral portion (e.g. 2024) of a female attachment element 2020 can be pulled away or otherwise disengaged from the male attachment element, a portion of a piece of fabric can be draped over or contacted with the male attachment element, and the peripheral portion can again be placed over or otherwise engaged with the male attachment element, so as to secure the portion of the piece of fabric between the female attachment element and the male attachment element.

Figure 21:
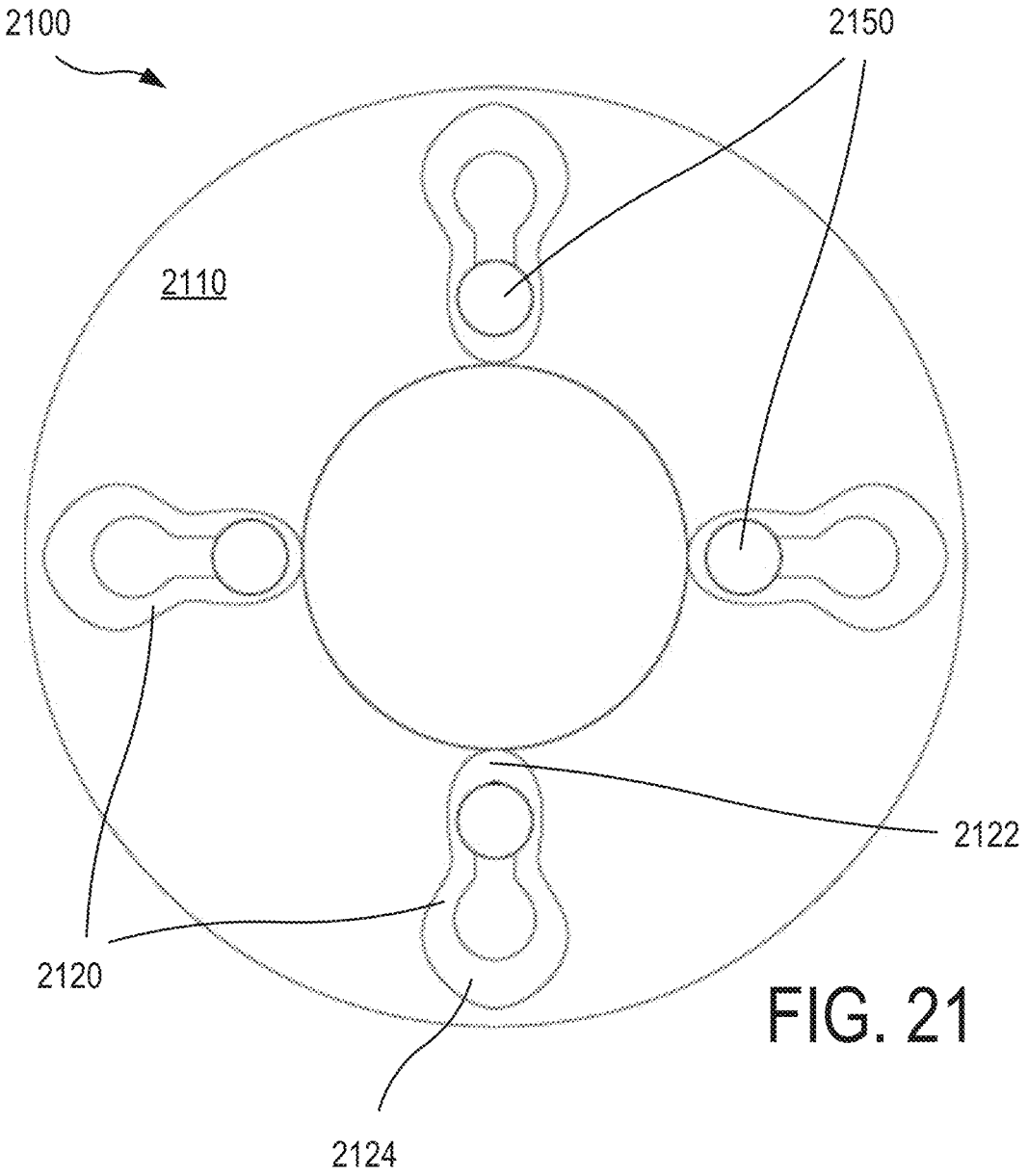
FIG. 21 depicts a top perspective view of an example of how a base and clip system could be one piece.

FIG. 21 depicts a top plan view of a one-piece system 2100 having a central base 2110 with multiple male attachment elements (e.g. 2150) and multiple female attachment elements (e.g. 2120). The male attachment elements 2150 can operate in cooperation with corresponding female attachment elements 2120 in a manner similar to that which is described with reference to FIG. 15. However in this embodiment, the female attachment elements 2120 do not detach from the base 2110. Instead, a peripheral portion (e.g. 2124) of a female attachment element 2120 is fixed or continuous with the base 2110. A central portion (e.g. 2122) of a female attachment element 2120 can be pulled away or otherwise disengaged from the male attachment element, a portion of a piece of fabric can be draped over or contacted with the male attachment element, and the peripheral portion can again be placed over or otherwise engaged with the male attachment element, so as to secure the portion of the piece of fabric between the female attachment element and the male attachment element.

Figure 22:
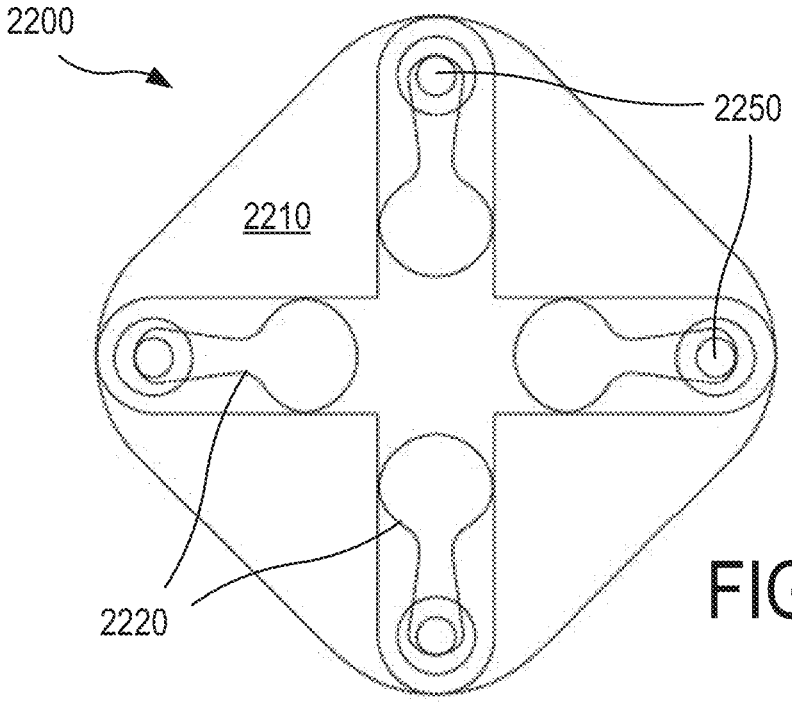
FIG. 22 depicts a top perspective view of an example of how the male and female components may be permanently attached as one unit with four attachment channels according to various embodiments of the present invention.

FIG. 22 depicts a top plan view of a one-piece system 2200 having a central base 2210 with multiple male attachment elements (e.g. 2250) and multiple female attachment elements (e.g. 2220). The male attachment elements 2250 can operate in cooperation with corresponding female attachment elements 2220 in a manner similar to that which is described with reference to FIGS. 6-8. In some embodiments, the male and female components may be permanently attached as one unit with four attachment channels.

Figure 23:
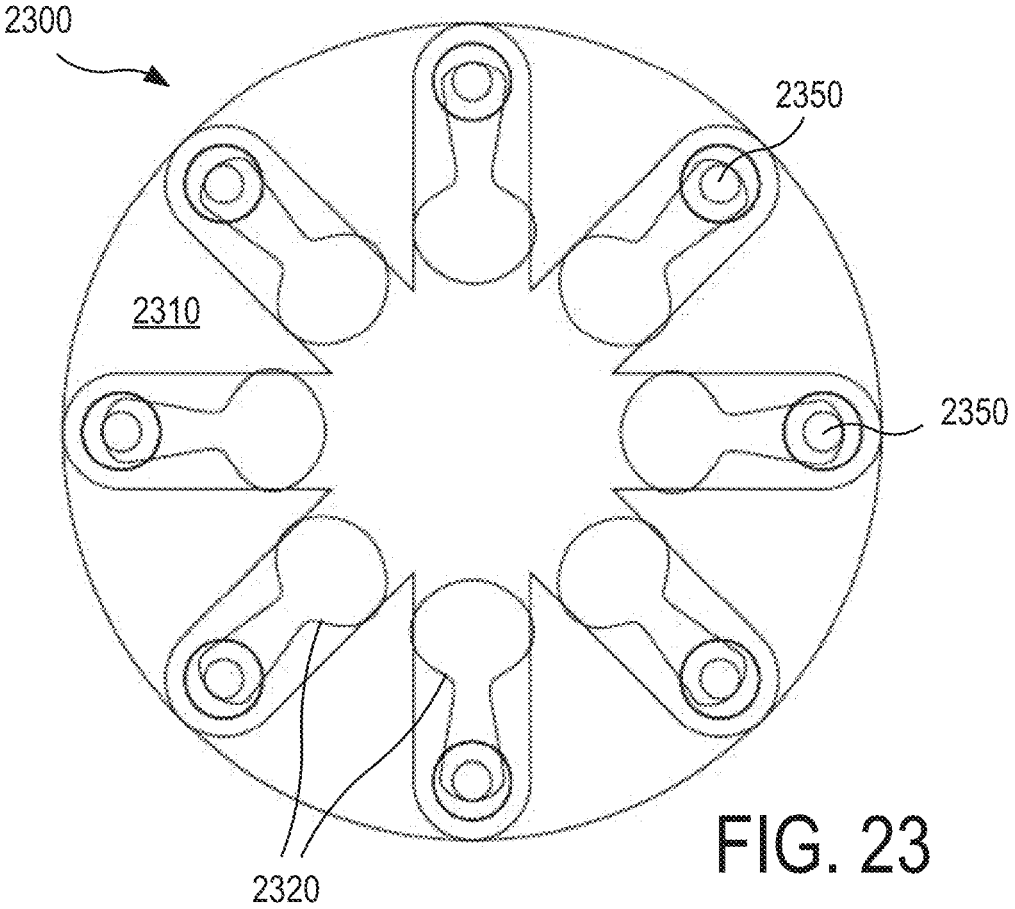
FIG. 23 depicts a top perspective view of an example of how the male and female components may be permanently attached as one unit with eight attachment channels according to various embodiments of the present invention.

FIG. 23 depicts a top plan view of a one-piece system 2300 having a central base 2310 with multiple male attachment elements (e.g. 2350) and multiple female attachment elements (e.g. 2320). The male attachment elements 2350 can operate in cooperation with corresponding female attachment elements 2320 in a manner similar to that which is described with reference to FIGS. 6-8. In some embodiments, the male and female components may be permanently attached as one unit with eight attachment channels.

Figure 24:
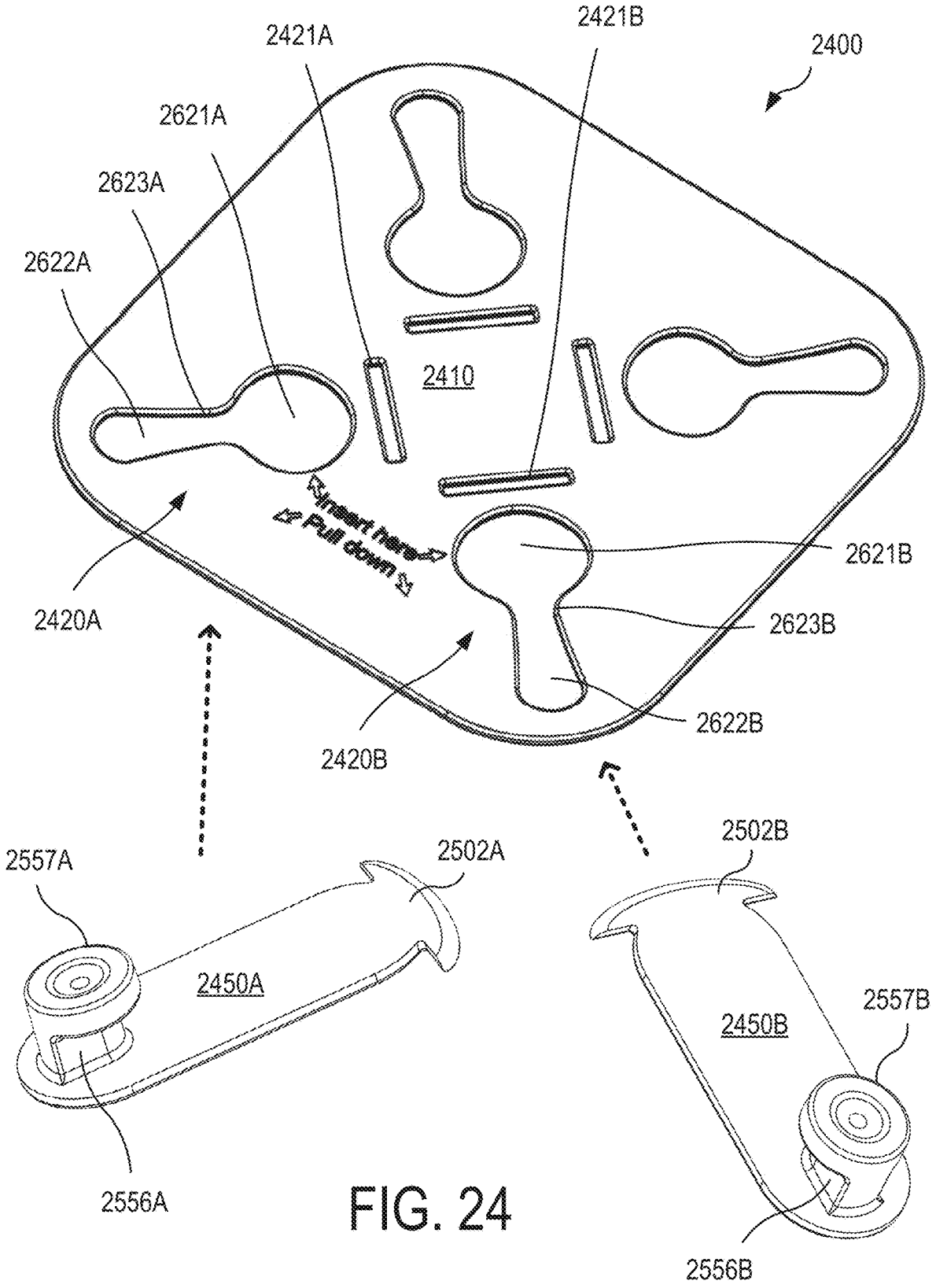
FIG. 24 depicts a top perspective view of aspects of a fabric securing device, according to various embodiments of the present invention.
Figure 25:
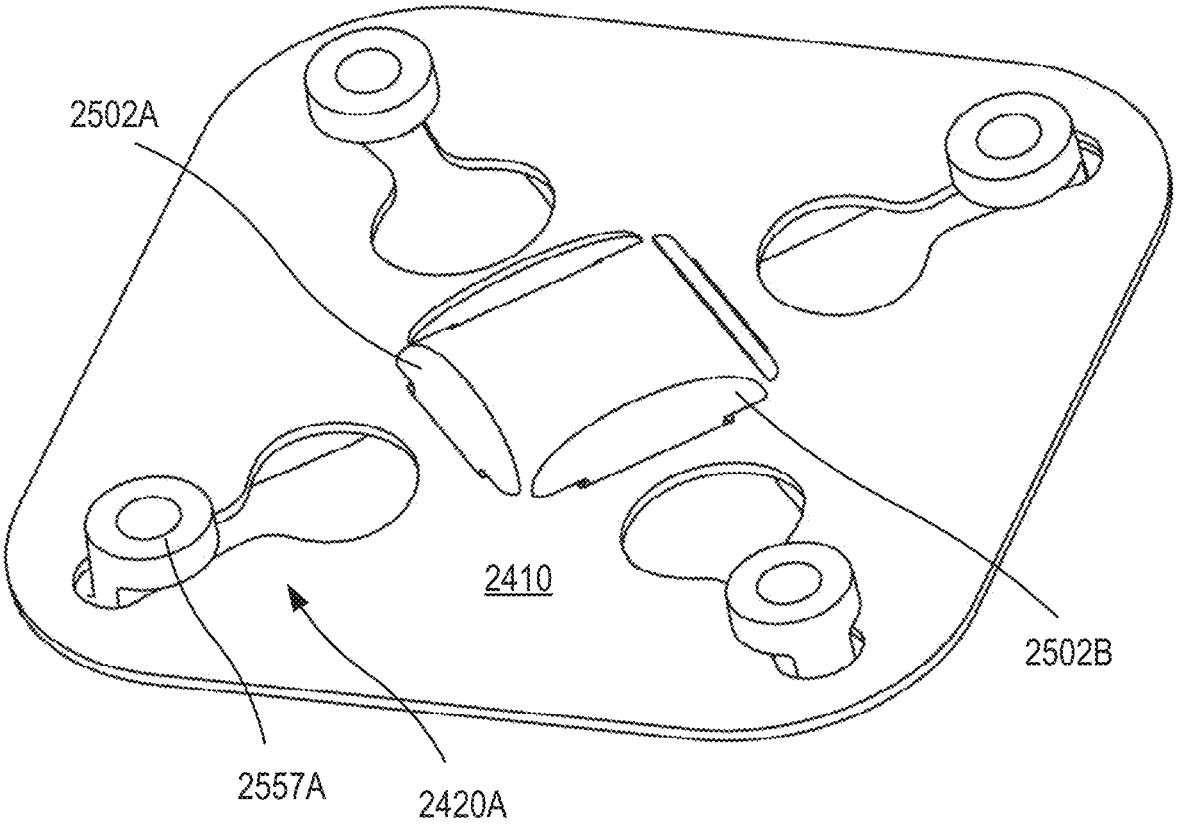
FIG. 25 depicts a perspective view of aspects of a fabric securing device, according to various embodiments of the present invention.

FIG. 24 depicts aspects of an assembly process for assembling a laundry system or fabric securing device 2400, according to some embodiments of the present invention. As shown here, a first male attachment member 2450A can be coupled with a central base 2410 by inserting a beveled flap 2502A of the first male attachment member 2540A through the first slit 2421A of the base 2410 (e.g. so that the beveled flap 2502A is disposed on a top side of the base 2410, as depicted in FIG. 25) and by inserting a cap 2557A of the first male attachment member 2540A through a central circular or widened portion 2621A of a first female attachment channel 2420A of the base 2410, and then moving the cap 2557A in a peripheral direction, so that a stem 2556A of the first male attachment member 2540A is squeezed or compressed as it passes through an intermediate narrowed portion 2623A of the first female attachment channel 2420A and into a peripheral circular or widened portion 2622A of the first female attachment channel 2420A (e.g. so that the cap 2557A is disposed on a top side of the base 2410, as depicted in FIG. 25). Likewise, a second male attachment member 2450B can be coupled with a central base 2410 by inserting a beveled flap 2502B of the second male attachment member 2540B through the second slit 2421B of the base 2410 (e.g. so that the beveled flap 2502B is disposed on a top side of the base 2410, as depicted in FIG. 25) and by inserting a cap 2557B of the second male attachment member 2540B through a central circular or widened portion 2621B of a second female attachment channel 2420B of the base 2410, and then moving the cap 2557B in a peripheral direction, so that a stem 2556B of the second male attachment member 2540B is squeezed or compressed as it passes through an intermediate narrowed portion 2623B of the second female attachment channel 2420B and into a peripheral circular or widened portion 2622B of the second female attachment channel 2420B (e.g. so that the cap 2557A is disposed on a top side of the base 2410). Third and fourth male attachment members (not shown in FIG. 24) can be coupled with the base 2410 in a likewise fashion. According to some embodiments, the top portion of the male member tapers before it gets to the flattened portion of the cap so that the process of inserting it into the slit is easier for assembly; the taper allows for the male member to be rotated slightly, making the flap come through the slit with little effort. The reverse process is more difficult, which is why the male members stay securely in the slit unless the user purposely maneuvers it to remove it.

Figure 26:
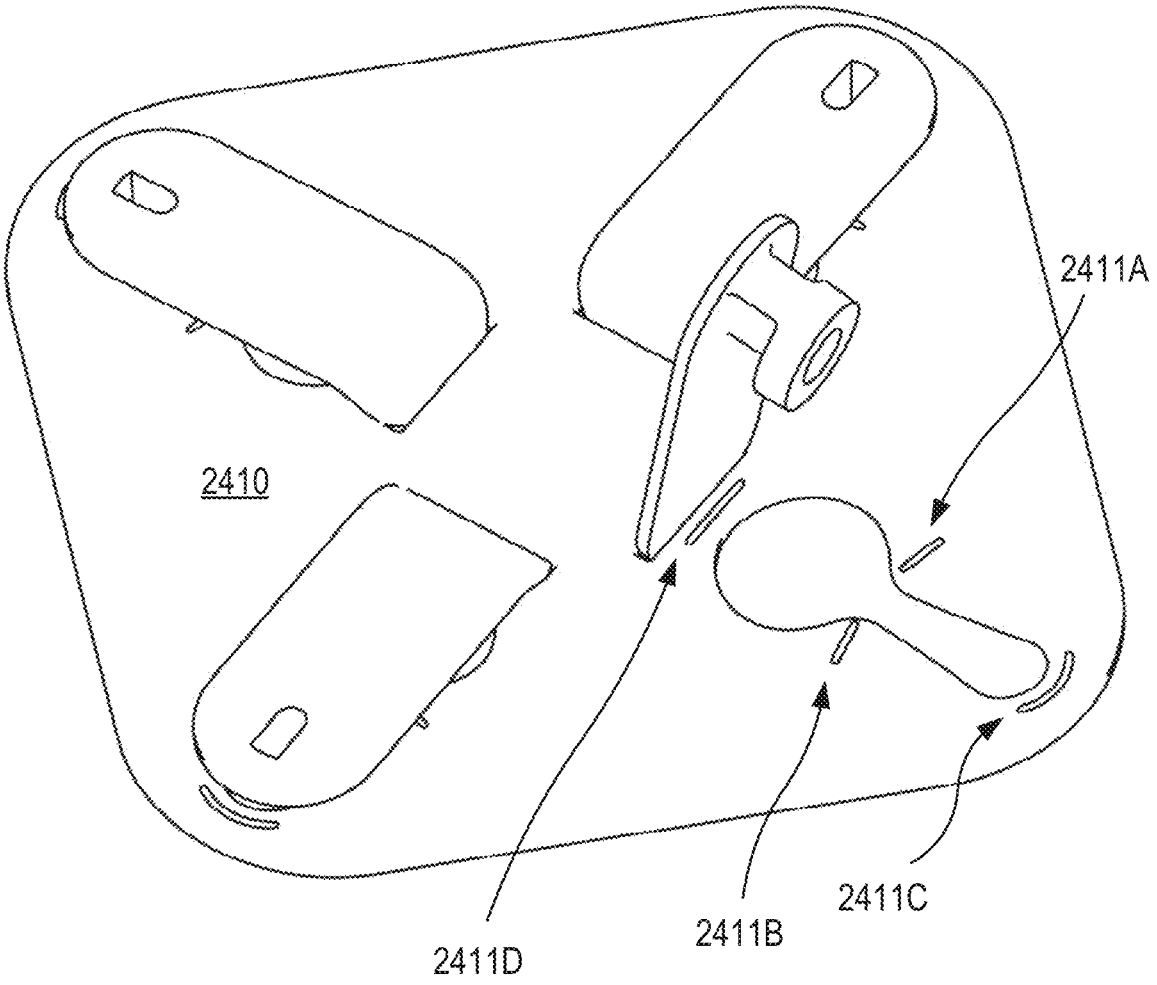
FIG. 26 depicts a perspective view of aspects of a fabric securing device, according to various embodiments of the present invention.

FIG. 26 depicts aspects of a base 2410 of a fabric securing device, according to some embodiments of the present invention. As shown here, the base 2410 can have one or more raised portions or thickened reinforcement sections 2411A, 2411B, 2411C, and 2411D that help to provide additional structural integrity to the base 2410 during use (e.g. when a male attachment member is engaged with the base).

Figure 27:
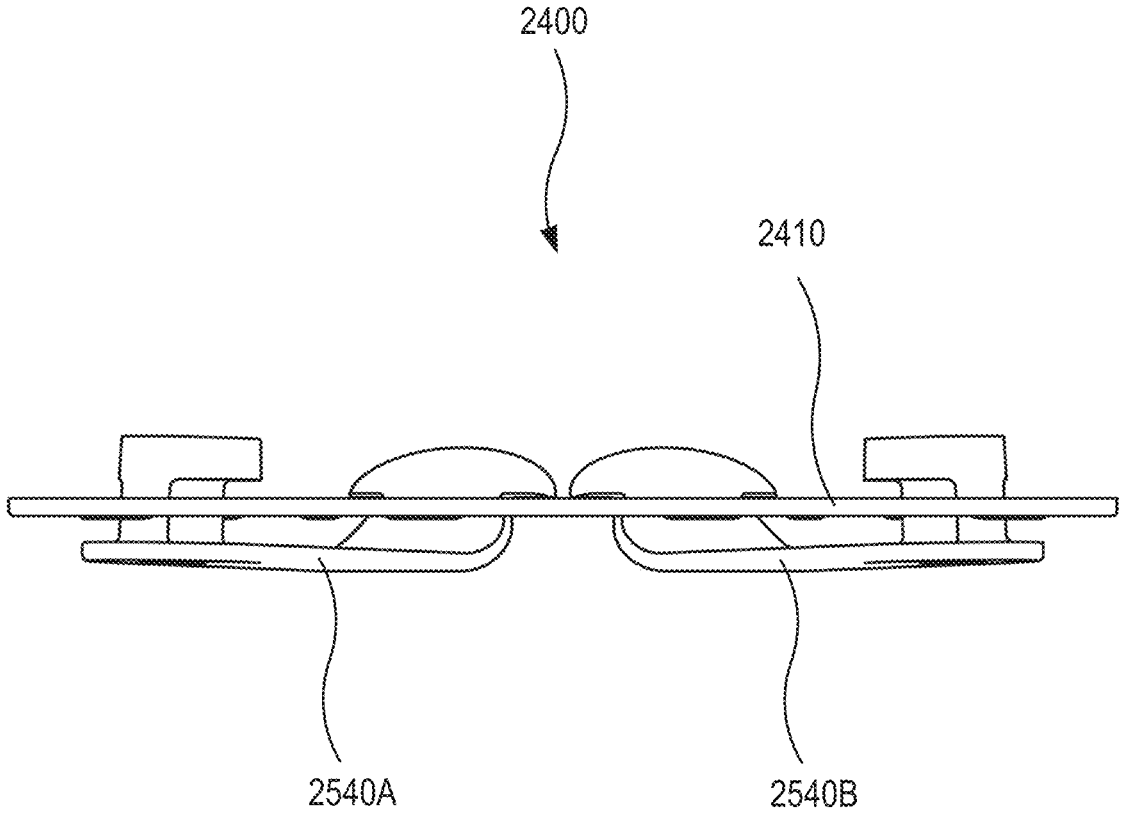
FIG. 27 depicts a side view of aspects of a fabric securing device, according to various embodiments of the present invention.

FIG. 27 depicts aspects of a base 2410 of a fabric securing device 2400, according to some embodiments of the present invention. As shown here, the base 2410 can be coupled with a first male attachment member 2540A and a second male attachment member 2540B.

In some instances, a user may wish to leave a laundry system or fabric securing device attached with an article of fabric (e.g. bedsheet, blanket, or the like) while the article of fabric is in use (e.g. bedsheet placed on bed). In this way, the device can be left attached to one bottom corner and tucked in when making the bed so that the user does not have to go looking for the device then next time they are going to wash their sheets.

In some instances, a user may wish to use a fabric securing device to secure two articles of fabric together. For example, with a four point attachment system such as that depicted in FIG. 24, two male attachment members (and corresponding female attachment members) can be secured to one article of fabric, and two other male attachment members (and corresponding female attachment members) can be secured to another article of fabric. In some instances, In some instances, one or more pieces of a fabric securing device can be replaceable. For example, a male attachment member can be replaceable, if one wears out during use.

All features of the described systems and devices are applicable to the described methods mutatis mutandis, and vice versa. Embodiments of the present invention encompass kits having systems for coupling or attaching with laundry articles as disclosed herein. In some embodiments, the kit includes one or more systems for coupling or attaching with laundry articles, along with instructions for using the system for example according to any of the methods disclosed herein.

Although the present invention has been illustrated and described herein with reference to preferred embodiments and specific examples thereof, it will be readily apparent to those of ordinary skill in the art that other embodiments and examples may perform similar functions and/or achieve like results, and that many other possible modifications and variations can be made without departing from the spirit and scope of the invention. All such equivalent embodiments and examples are within the spirit and scope of the present invention, are contemplated thereby, and are intended to be covered by the following claims.

Although the foregoing invention has been described in some detail by way of illustration and example for purposes of clarity of understanding, one of skill in the art will appreciate that certain changes, modifications, alternate constructions, and/or equivalents may be practiced or employed as desired, and within the scope of the appended claims. In addition, each reference provided herein in incorporated by reference in its entirety to the same extent as if each reference was individually incorporated by reference. Relatedly, all publications, patents, patent applications, journal articles, books, technical references, and the like mentioned in this specification are herein incorporated by reference to the same extent as if each individual publication, patent, patent application, journal article, book, technical reference, or the like was specifically and individually indicated to be incorporated by reference.

What is claimed is:

1. A method of attaching an article of fabric with a fabric securing device, the method comprising:

providing a fabric securing device comprising:

a rigid base having a first keyhole, a first slit-hole located next to the first keyhole, a second keyhole, and a second slit-hole located next to the second keyhole;

a first flexible tongue having a neck, a crescent-shaped beveled edge, a top surface, a bottom surface, a hollow post protruding from the top surface, and an opening in the bottom surface opposite the hollow post; and a second flexible tongue having a neck, a crescent-shaped beveled edge, a top surface, a bottom surface, a hollow post protruding from the top surface, and an opening in the bottom surface opposite the hollow post, wherein the first keyhole is configured to receive the hollow post of the first tongue and the first slit-hole is configured to receive the beveled edge of the first tongue, thereby providing a reversible coupling between the base and the first tongue, wherein the second keyhole is configured to receive the hollow post of the second tongue and the second slit-hole is configured to receive the beveled edge of the second tongue, thereby providing a coupling between the base and the second tongue, and wherein the fabric securing device is configured to attach with an article of fabric when the hollow post of the first tongue is located in the first keyhole of the base and a first section of the article of fabric is positioned between the hollow post of the first tongue and the first keyhole of the base, and when the hollow post of the second tongue is located in the second keyhole of the base and a second section of the article of fabric is positioned between the hollow post of the second tongue and the second keyhole of the base;

attaching the article of fabric with the fabric securing device by positioning a first section of the article of fabric between the hollow post of the first tongue and the first keyhole of the base, and positioning a second section of the article of fabric between the hollow post of the second tongue and the second keyhole of the base.

2. The method of claim 1, wherein the first keyhole of the base has a circular portion and a narrow portion, wherein the narrow portion is connected to the circular portion and is most narrow where the circular portion and narrow portion join and the width increases from where the circular portion and narrow portion join to the end of the narrow portion.

3. The method of claim 2, wherein the hollow post of the first tongue is configured to compress when sliding from the circular portion into the narrow portion of the first keyhole of the base and expand when sliding along the narrow portion away from the circular portion of the first keyhole of the base.

4. The method of claim 3, wherein the hollow post of the second tongue is configured to compress when sliding from the circular portion into the narrow portion of the second keyhole of the base and expand when sliding along the narrow portion away from the circular portion of the second keyhole of the base.

5. The method of claim 1, further comprising a third flexible tongue having a neck, a crescent-shaped beveled edge, a top surface, a bottom surface, a hollow post protruding from the top surface, and an opening in the bottom surface opposite the hollow post, wherein the rigid base further comprises a third keyhole, and a third slit-hole located next to the third keyhole, wherein the third keyhole is configured to receive the hollow post of the third tongue and the third slit-hole is configured to receive the beveled edge of the third tongue, thereby providing a reversible coupling between the base and the third tongue, and wherein the fabric securing device is configured to further attach with the article of fabric when the hollow post of the third tongue is located in the third keyhole of the base and a third section of the article of fabric is positioned between the hollow post of the third tongue and the third keyhole of the base.

6. The method of claim 5, wherein the third keyhole of the base has a circular portion and a narrow portion, wherein the narrow portion is connected to the circular portion and is most narrow where the circular portion and narrow portion join and the width increases from where the circular portion and narrow portion join to the end of the narrow portion.

7. The method of claim 6, wherein the hollow post of the third tongue is configured to compress when sliding from the circular portion into the narrow portion of the third keyhole of the base and expand when sliding along the narrow portion away from the circular portion of the third keyhole of the base.

8. The method of claim 5, wherein the fabric securing device further comprises a fourth flexible tongue having a neck, a crescent-shaped beveled edge, a top surface, a bottom surface, a hollow post protruding from the top surface, and an opening in the bottom surface opposite the hollow post, wherein the rigid base further comprises a fourth keyhole, and a fourth slit-hole located next to the fourth keyhole, wherein the fourth keyhole is configured to receive the hollow post of the fourth tongue and the fourth slit-hole is configured to receive the beveled edge of the fourth tongue, thereby providing a reversible coupling between the base and the fourth tongue, and wherein the fabric securing device is configured to further attach with the article of fabric when the hollow post of the fourth tongue is located in the fourth keyhole of the base and a fourth section of the article of fabric is positioned between the hollow post of the fourth tongue and the fourth keyhole of the base.

9. The method of claim 8, wherein the fourth keyhole of the base has a circular portion and a narrow portion, wherein the narrow portion is connected to the circular portion and is most narrow where the circular portion and narrow portion join and the width increases from where the circular portion and narrow portion join to the end of the narrow portion.

10. The method of claim 9, wherein the hollow post of the fourth tongue is configured to compress when sliding from the circular portion into the narrow portion of the fourth keyhole of the base and expand when sliding along the narrow portion away from the circular portion of the fourth keyhole of the base.

11. The method of claim 1, wherein the hollow post of the first tongue has an indented bowl-shaped top.

12. The method of claim 1, wherein the hollow post of the second tongue has an indented bowl-shaped top.

13. The method of claim 5, wherein the hollow post of the third tongue has an indented bowl-shaped top.

14. The fabric securing device of claim 8, wherein the hollow post of the fourth tongue has an indented bowl-shaped top.

15. The method of claim 1, wherein a cap of the hollow post of the first flexible tongue has a peripheral face that is flush with a peripheral face of a stem of the hollow post of the first flexible tongue, and wherein the stem of the hollow post of the first flexible tongue has an inner face that is disposed peripherally to an inner face of the cap of the hollow post of the first flexible tongue.

16. The method of claim 15, wherein a cap of the hollow post of the second flexible tongue has a peripheral face that is flush with a peripheral face of a stem of the hollow post of the second flexible tongue, and wherein the stem of the hollow post of the second flexible tongue has an inner face that is disposed peripherally to an inner face of the cap of the hollow post of the second flexible tongue.

17. The method of claim 5, wherein a cap of the hollow post of the third flexible tongue has a peripheral face that is flush with a peripheral face of a stem of the hollow post of the third flexible tongue, and wherein the stem of the hollow post of the third flexible tongue has an inner face that is disposed peripherally to an inner face of the cap of the hollow post of the third flexible tongue.

18. The method of claim 8, wherein a cap of the hollow post of the fourth flexible tongue has a peripheral face that is flush with a peripheral face of a stem of the hollow post of the fourth flexible tongue, and wherein the stem of the hollow post of the fourth flexible tongue has an inner face that is disposed peripherally to an inner face of the cap of the hollow post of the fourth flexible tongue.

* * * * *